US012612797B2

(12) United States Patent
Tsampras et al.

(10) Patent No.: US 12,612,797 B2
(45) Date of Patent: Apr. 28, 2026

(54) FRICTION DEVICES FOR ENERGY DISSIPATION

(71) Applicant: The Regents of the University of California, Oakland, CA (US)

(72) Inventors: Georgios Tsampras, San Diego, CA (US); Kaixin Chen, La Jolla, CA (US)

(73) Assignee: The Regents of the University of California, Oakland, CA (US)

( * ) Notice: Subject to any disclaimer, the term of this patent is extended or adjusted under 35 U.S.C. 154(b) by 198 days.

(21) Appl. No.: 18/508,087

(22) Filed: Nov. 13, 2023

(65) Prior Publication Data

US 2024/0159074 A1 May 16, 2024

Related U.S. Application Data

(60) Provisional application No. 63/383,222, filed on Nov. 10, 2022.

(51) Int. Cl.
*E04H 9/02* (2006.01)

(52) U.S. Cl.
CPC ..... *E04H 9/0215* (2020.05)

(58) Field of Classification Search
CPC ..... E04H 9/0237; E04H 9/021; E04H 9/024; E04H 9/027; E04B 1/98
See application file for complete search history.

(56) References Cited

U.S. PATENT DOCUMENTS 3,747,969 A * 7/1973 Diener ..... B60R 19/26 293/133
7,076,926 B2 * 7/2006 Kasai ..... E04H 9/0237 52/167.7
8,505,260 B1 * 8/2013 Chang ..... E04H 9/0237 52/704
8,763,320 B1 * 7/2014 Chou ..... E04H 12/16 52/167.3

(Continued)

OTHER PUBLICATIONS

Chen, Kaixin , "Reusable Force-Limiting Connection With Variable Friction Force for High-Performance Buildings", 8th Asia Conference on Earthquake Engineering, Taipei, Taiwan, Nov. 9-11, 2022, 8 pages.

(Continued)

*Primary Examiner* — Brian E Glessner
*Assistant Examiner* — Daniel J Kenny
(74) *Attorney, Agent, or Firm* — Perkins Coie LLP

(57) ABSTRACT

Friction devices and systems for dissipating energy from a structure are provided. In various embodiments, the friction device may include a first friction assembly including a first plate and a second plate and configured to generate a first friction force by a movement of the first plate relative to the second plate; a first fastener assembly configured to exert a first normal force onto the first friction assembly; a second friction assembly including auxiliary pads and configured to generate a second friction force by a movement of the auxiliary pads relative to the second plate when the auxiliary pads are coupled to the first plate; and a second fastener (Continued)

assembly configured to exert a second normal force onto the second friction assembly, in which energy is dissipated by a total friction force that is a sum of the first friction force and the second friction force and discretely variable.

20 Claims, 19 Drawing Sheets

(56) References Cited

U.S. PATENT DOCUMENTS

| | | | | |
|---|---|---|---|---|
| 8,807,307 | B2 * | 8/2014 | Choi | E04H 9/0237 248/562 |
| 10,323,430 | B1 * | 6/2019 | Pall | E04H 9/024 |
| 11,371,241 | B2 * | 6/2022 | Jiang | E04B 1/98 |
| 11,879,264 | B2 * | 1/2024 | Montgomery | E04H 9/0215 |
| 2015/0135611 | A1 * | 5/2015 | Beard | E04H 9/024 52/167.3 |

OTHER PUBLICATIONS

Lee, Kyoungyeon , "Seismic Response of Core Wall Building with Friction-Based Force-Limiting Connections", in 3rd European Conference on Earthquake Engineering & Seismology (3ECEES), 2022, 9 pages.

Tsampras, Georgios , "Development of Deformable Connection for Earthquake-resistant Buildings to Reduce Floor Accelerations and Force Responses", Earthquake Engineering & Structural Dynamics 2016 45(9), doi: 10.1002/eqe.2718, pp. 1473-1494.

Tsampras, Georgios , "Experimental Study of Deformable Connection Consisting of Buckling-Restrained Brace and Rubber Bearings to Connect Floor System to Lateral Force Resisting System", Earthquake Engineering & Structural Dynamics 46(8), doi: 10.1002/eqe.2856, 2017, pp. 1287-1305.

Tsampras, Georgios , "Experimental Study of Deformable Connection Consisting of Friction Device and Rubber Bearings to Connect Floor System to Lateral Force Resisting System", Earthquake Engineering & Structural Dynamics 47(4), doi: 10.1002/eqe.3004, 2018, pp. 1032-1053.

Tsampras, Georgios , "Force-Based Design Method for Force-Limiting Deformable Connections in Earthquake-Resistant Buildings", Journal of Structural Engineering 148(10):04022150. doi: 10.1061/(ASCE)ST.1943-541X.0003456, 2022, 15 pages.

Tsampras, Georgios , "Force-Limiting Deformable Floor Diaphragm Connection for Earthquake-Resistant Buildings (Part 1 of 5)", Doctoral dissertation, Lehigh University, 2016, 109 pages.

Tsampras, Georgios , "Force-Limiting Deformable Floor Diaphragm Connection for Earthquake-Resistant Buildings (Part 2 of 5)", Doctoral dissertation, Lehigh University, 2016, 38 pages.

Tsampras, Georgios , "Force-Limiting Deformable Floor Diaphragm Connection for Earthquake-Resistant Buildings (Part 3 of 5)", Doctoral dissertation, Lehigh University, 2016, 23 pages.

Tsampras, Georgios , "Force-Limiting Deformable Floor Diaphragm Connection for Earthquake-Resistant Buildings (Part 4 of 5)", Doctoral dissertation, Lehigh University, 2016, 72 pages.

Tsampras, Georgios , "Force-Limiting Deformable Floor Diaphragm Connection for Earthquake-Resistant Buildings (Part 5 of 5)", Doctoral dissertation, Lehigh University, 2016, 29 pages.

Zhang, D , "Development of a Floor Inertial Force Limiting Anchorage System Building Seismic Response", 2014, in 10th U.S. National Conference on Earthquake Engineering, 21 pages.

Zhang, Zhi , "Shake-Table Test Performance of an Inertial Force-Limiting Floor Anchorage System", Earthquake Engineering & Structural Dynamics 47(10), 2018, doi: 10.1002/eqe.3047, pp. 1987-2011.

* cited by examiner (a) Friction device (b)

(a) Planar wall system (b) Core wall system

FRICTION DEVICES FOR ENERGY DISSIPATION

CROSS-REFERENCE TO RELATED APPLICATIONS

This patent document claims priority to and benefits of U.S. Provisional Patent Application No. 63/383,222 entitled "connection devices for building structures" filed on Nov. 10, 2022. The entire content of the aforementioned patent application is incorporated by reference as part of the disclosure of this patent document.

TECHNICAL FIELD

This patent document relates to friction devices and systems for dissipating energy from a structure.

BACKGROUND

A friction device in earthquake-resistant building design is a type of seismic damper that uses friction to dissipate the energy from an earthquake, reducing the movement in the building and improving its resilience to seismic activity.

SUMMARY

The technology disclosed in this patent document relates to friction devices and systems for dissipating energy from a structure. One aspect of the present document relates a friction device for dissipating seismic energy in a structure. In some embodiments, the friction device includes: two external plates and an internal plate arranged substantially parallel to each other, wherein the internal plate is positioned between the two external plates and wherein a first friction force is generated by a movement of the two external plates relative to the internal plate; a set of auxiliary pads in contact with the internal plate, wherein a second friction force is generated by a movement of the auxiliary pads relative to the internal plate in response to a movement of the one or both of the two external plates that exceeds a predetermined value; and a set of fasteners configured to attach the two external plates to each other and to exert a normal force thereupon, wherein the at least one of the first friction force or the second friction force depend on the normal force, and wherein the friction device is configured to dissipate at least a portion of the seismic energy due to at least one of the first friction force or the second friction force.

Another aspect of the present document relates a friction device for dissipating energy. In some embodiments, the friction device includes: a first friction assembly including a first plate and a second plate, in which a first friction assembly comprising a first plate and a second plate, wherein the first friction assembly is configured to generate a first friction force by a movement and the first plate relative to the second plate, a first fastener assembly configured to exert a first normal force onto the first friction assembly, a second friction assembly comprising a plurality of auxiliary pads, wherein the second auxiliary pads is configured to generate a second friction force by a movement of one or more of the plurality of auxiliary pads relative to the second plate in response to a movement of the first plate that exceeds a predetermined value, a second fastener assembly configured to exert a second normal force onto the second friction assembly, in which: the first friction force relates to the first normal force; the second friction force relates to the second normal force; and the friction device is configured to dissipate the energy by a total friction force that is a sum of the first friction force and the second friction force.

A further aspect of the present document relates an energy dissipation system for a structure. In some embodiments, the energy dissipation system includes: a plurality of friction devices, in which each of the plurality of friction devices includes: a first friction assembly comprising a first plate and a second plate, in which the first friction assembly is configured to generate a first friction force by a movement of the first plate relative to the second plate, a first fastener assembly configured to exert a first normal force onto the first friction assembly, a second friction assembly comprising a plurality of auxiliary pads, wherein the second friction assembly is configured to generate a second friction force by a movement of one or more of the plurality of auxiliary pads relative to the second plate when the one or more of the plurality of auxiliary pads are coupled to the first plate in response to a movement of the first plate that exceeds a predetermined value, and a second fastener assembly configured to exert a second normal force onto the second friction assembly, in which: the first friction force depends on the first normal force; the second friction force depends on the second normal force; and the friction device is configured to dissipate energy by a total friction force that is a sum of the first friction force and the second friction force, in which the plurality of friction devices are operatively connected to a structural framework of the structure. In some embodiments, the structural framework may include at least one of a beam, a column, a floor, or a brace of the structure. The system may include a sensor configured to monitor at least one of the plurality of friction devices, the structural framework, or another portion of the structure. In some embodiments, the plurality of friction devices of the system may include a first friction device and a second friction device that are arranged in a substantially same orientation such that a relative movement between the first plate and the second plate of the first friction device is substantially in a same direction as a relative movement between the first plate and the second plate of the second friction device. In some embodiments, the plurality of friction devices may include a first friction device and a second friction device that are arranged in different orientations (e.g., substantially perpendicular to each other) such that a relative movement between the first plate and the second plate of the first friction device is in a different direction than a relative movement between the first plate and the second plate of the second friction device (e.g., substantially perpendicular to each other).

A still further aspect of the present patent document provides models for simulating an event that imposes energy on a structure (e.g., an earthquake), a structure subject to the energy, a friction device as disclosed herein, a structure with or without such a friction device, and deformation and/or force the structure subjected to with or without such a friction device. Such a model may be configured to estimate a condition of the structure during or after such an event, to guide a design of a friction device as disclosed herein, positioning of one or more of such friction devices in the structure to improve its resistance to such an event, or the like, or a combination thereof.

The above and other aspects of the disclosed technology and their implementations and applications are described in greater detail in the drawings, the description and the claims.

BRIEF DESCRIPTION OF THE DRAWINGS

It is understood that the drawings are not to scale. Like reference numerals indicate like components.

DETAILED DESCRIPTION

The technology disclosed in this patent document relates to friction devices and systems for dissipating energy from a structure. Such a friction device (FD) may be used as a structural connection that is connected directly or indirectly (e.g., via a force-resisting system) to a portion or structural framework of a structure. In some embodiments, the friction device (also referred to as a modified friction device (Modified FD) herein) is configured to generate discrete variable friction forces to dissipate energy (e.g., seismic energy relating to a seismic event) exerted on the structure. Merely by way of example, Modified FDs as disclosed herein may be used to transfer the seismic induced horizontal forces from the floors to the core wall seismic force-resisting system of a building. Accordingly, the Modified FDs may provide a simple and practical structural connection with predetermined or known discrete variable force-displacement response to limit the seismic induced horizontal forces transferred between the floors of the flexible gravity load resisting system and the core wall piers in high-performance earthquake resilient buildings.

Figure 1:
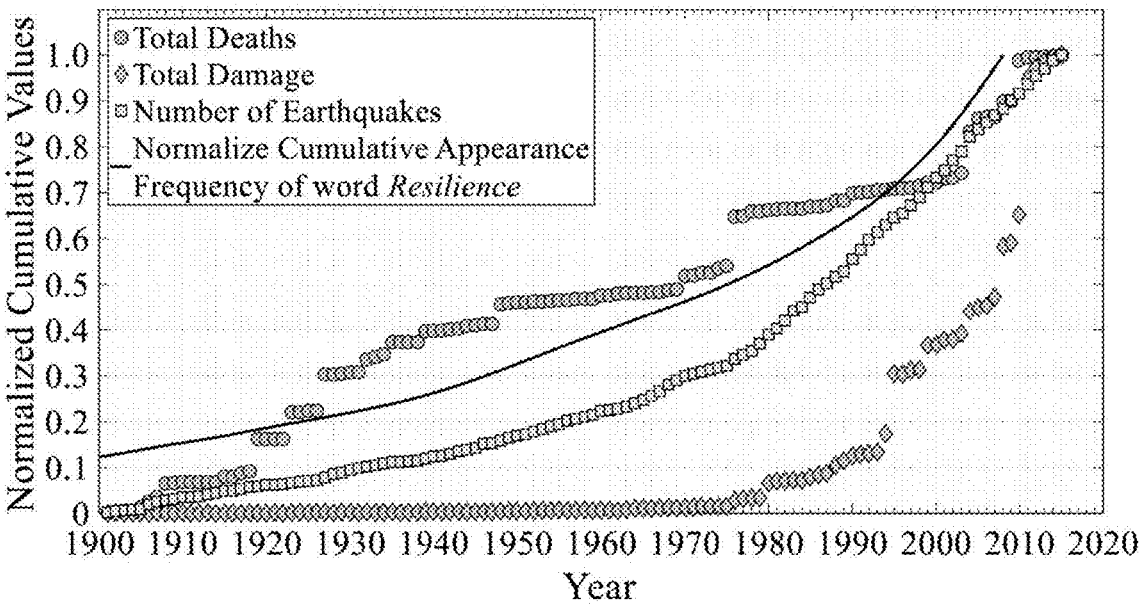
FIG. 1 shows normalized cumulative annual total deaths, total damage, number of large earthquakes, and appearance frequency of the word Resilience based on information available in the CRED/OFDA International Disaster Database from Universito Catholique de Louvain, Brussels, Belgium.

The technical problems to be solved by FDs and systems as disclosed may be illustrated by way of example of the significant earthquake events occurred in Christchurch, New Zealand in February 2011. One hundred and eighty-two fatalities and total damage of 18 billion US dollars were reported. After the earthquake events, approximately 1240 buildings were demolished in the central city of Christchurch. For five years, from 29 Mar. 2011 until 18 Apr. 2016, the Canterbury Earthquake Recovery Authority (CERA) led and coordinated the response and recovery efforts. This earthquake event is one out of the 905 large earthquakes reported from 1901 until 2015. The CRED/OFDA International Disaster Database from Universito Catholique de Louvain, Brussels, Belgium provides annual data related to the total deaths, the total damage, and the number of large earthquakes. An exemplary analysis of the data and a plot of their cumulative normalized values are illustrated in FIG. 1 provided by Tsampras in "Force-limiting floor diaphragm connection for earthquake-resistant buildings" (2016). FIG. 1 also shows the normalized cumulative frequency of appearance of the word "Resilience" (defined in the following section) in the English corpus of Google Ngram between 1900 and 2008. The reported annual total number of large earthquakes was higher between 1980 and 2015 compared to previous years, possibly because of improved data collection. The word Resilience appeared more often in the literature during the same period of years compared to past years. The reported annual total damage was higher between 1980 and 2015 compared to past years, although it is possible that damage existed but was not included in the database. In addition, between 1980 and 2015, the reported annual total deaths were significant compared to the past years, despite the advancement of engineering knowledge and practice. The high concentration of population in earthquake-prone regions (e.g., the population in California doubled from 1960 to 2000 and continues to increase) and the growth of infrastructure may contribute to the observed trend. Accordingly, there is a need for earthquake resilience.

U.S. National earthquake resilience is one of the priorities of the National Earthquake Hazards Reduction Program (NEHRP). According to the National Research Council of the National Academies, "A disaster-resilient nation is one in which its communities, through mitigation and pre-disaster preparation, develop the adaptive capacity to maintain important community functions and recover quickly when major disasters occur." Some have defined community resilience as "the ability to prepare for anticipated hazards, adapt to changing conditions, and withstand and recover from disruptions." However, requirements in current codes and standards focus primarily on life safety objectives for buildings and transportation, and on reliability for electric and water.

Designing individual buildings to recover at a functional level promptly after a seismic or earthquake event may contribute to community resilience and, as a result, enhance the national earthquake resilience. Individual buildings can be designed to return to a target functionality state after a given period if resilience-based design methods are used. High-performance building systems can be utilized to mitigate the expected damage in the structural and non-structural components. In 2015, the Building Seismic Safety Council recommended research to advance the state of the art in earthquake-resistant building design and identified issues in the current procedures used for the analysis and design of buildings. Federal Emergency Management Agency (FEMA) published issues and research needs related to the future development of the NEHRP Provisions and seismic design methods. Key issues are associated with the "Specific performance objectives and associated design criteria for performance beyond current code" and provisions associated with "better-than-code" structural systems. Examples of "better-than-code" structural systems include buildings with components in their seismic load path that can be designed to achieve high seismic performance compared to conventional building systems.

The design of conventional earthquake-resistant building systems is associated with uncertainty in the prediction of their seismic response. This uncertainty may be a result of the variability in the earthquake ground motions, and the variability in the structural characteristics and their evolution in time, which in turn affects the nonlinear response of the building components. More specifically, the variability in the seismic response of structural connections can be high due to the complex interactions resulting from the need to preserve kinematic compatibility between structural components. For example, the framing interaction between the floor diaphragms and the seismic force-resisting systems may lead to damage of the connection that results in uncontrolled transfer of forces. Because of this uncontrolled response, the seismic induced horizontal forces in the floor diaphragms can be large relative to the floor diaphragm strength and may lead to a non-ductile response of the diaphragms. The development of excessive seismic induced inertial forces can also produce inelastic responses and significant damage to the seismic force-resisting system. More specifically, the loss of the ability of the connections of diaphragms to transfer forces to the seismic force-resisting system may lead to local collapse of the floor or complete collapse of the building. After the 2010-2011 Christchurch earthquakes, excessive damage and collapse of floor diaphragms were attributed to inadequate integrity of the load path, underestimation of seismic-induced horizontal forces, and poorly understood interactions between floor diaphragms and walls, supporting beams, and reinforced concrete moment frames. The damage repairs required after the 2010-2011 Christchurch earthquakes highlighted the need for the development of low-damage high-performance earthquake-resilient seismic force-resisting systems.

Figure 2:
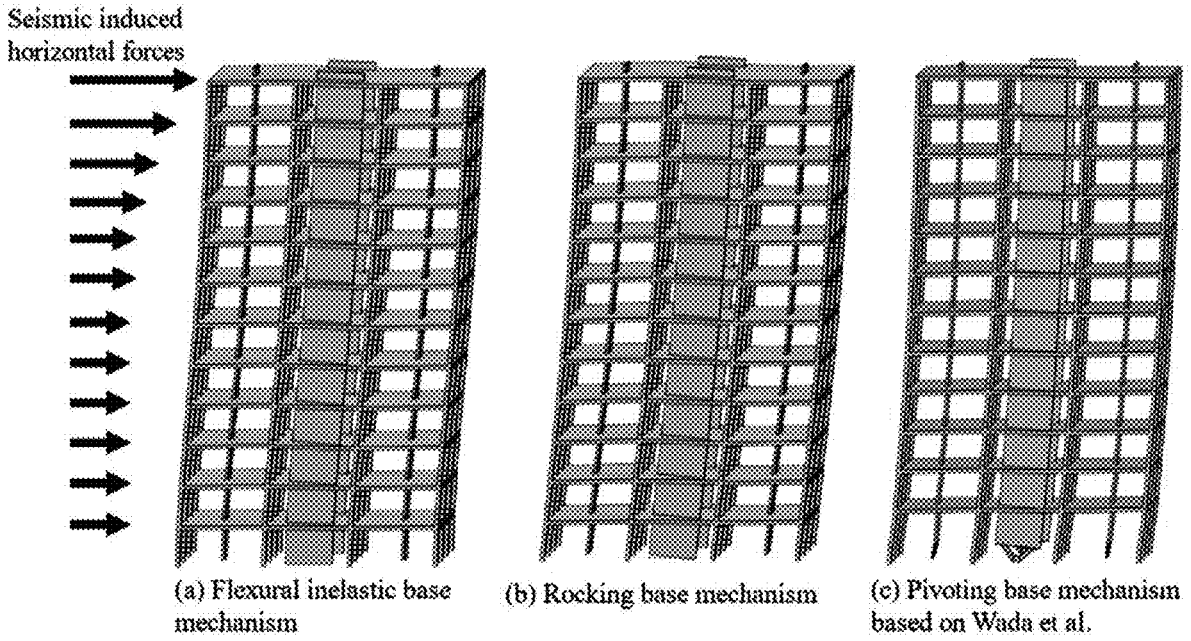
FIG. 2 shows sketches of example planar wall buildings with (a) flexural inelastic base mechanism, (b) rocking base mechanism, and (c) pivoting base mechanism.

A "stepping wall" provides an example of a seismic force-resisting system of the structure. A stepping wall has energy absorbers to control the response of the structure. Damage may be concentrated on the energy absorbers that may be replaced after a strong ground motion. Research has been conducted to develop seismic force-resisting systems with low post-earthquake damage and replaceable structural components. Examples include post-tensioned moment-resisting frames, rocking structural wall systems, and rocking frame systems. For example, strengthening moment-resisting frames with walls that are able to pivot at their base instead of rocking mechanism can reduce the drift demands in a building. As another example, vertical seismic force-resisting systems with rocking or pivoting base mechanism may prevent the localization of the story drift demand at a particular story in a frame building. As a further example, "strongbacks" or "spines" with a pivoting base mechanism may be used in addition to energy dissipation mechanisms to resist the seismic induced horizontal forces, prevent the localization of the story drift demand at a particular story in a frame building, and limit the floor accelerations. FIG. 2 shows sketches of example planar wall buildings with (a) flexural inelastic base mechanism, (b) rocking base mechanism, and (c) pivoting base mechanism.

The nonlinear response of the vertical elements of the seismic force-resisting system can act as a "cut-off" mechanism that may limit the floor accelerations and, as a result, limit the seismic induced horizontal inertial forces. Even when the ductile nonlinear response of the seismic force-resisting system occurs, high floor accelerations may be observed, due to the uncontrolled forces transferred between the floors and the vertical elements of the seismic force-resisting system and the amplified response of second and higher modes. Studies of buildings with seismic force-resisting systems that develop a flexural inelastic base mechanism (e.g., flexural-dominated reinforced concrete structural walls), a rocking base mechanism (e.g., rocking structural walls or controlled rocking braced frames), or a pivoting base mechanism show that high floor accelerations due to the contribution of the second-mode and higher-mode response in the total dynamic response (termed higher-mode effects) can be expected.

To limit the higher-mode effects in high-rise structural wall buildings with flexural inelastic base mechanism, a dual-plastic hinge design concept may be employed, which introduces a second plastic hinge along the height of the structural wall. To control the higher-mode effects in rocking frames, multiple rocking mechanisms above the rocking base mechanism may be employed.

Practical force-limiting connections may be employed to limit the seismic induced horizontal forces transferred from the floors to the vertical elements of planar seismic force-resisting systems in earthquake-resistant buildings and limit the higher-mode effects. A force-limiting connection may include a friction device or a buckling-restrained brace and low-damping rubber bearings. The force-limiting connection may be designed to accommodate the seismic induced three-dimensional kinematic requirements between floors and planar seismic force-resisting systems. Low-damping rubber bearings may provide out-of-plane stability to the planar walls of the seismic force-resisting system and post-elastic stiffness to the force-limiting connections. The post-elastic stiffness in the force-limiting connection may limit the seismic induced displacement of the floors relative to the planar seismic force-resisting system.

Figure 3:
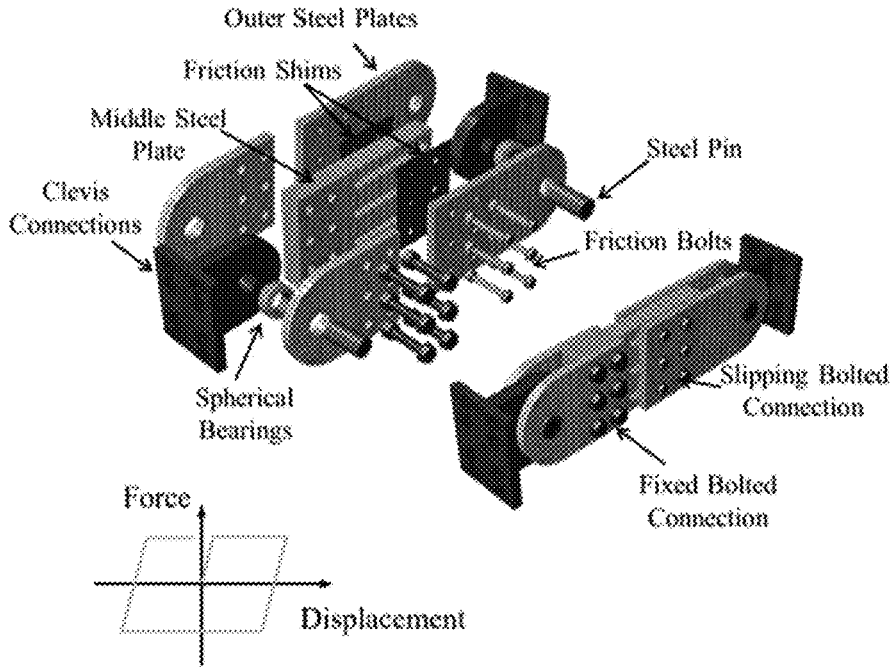
FIG. 3 shows an example force-limiting connection that includes a friction device and low-damping rubber bearings installed in an example building with rocking walls.
Figure 3:
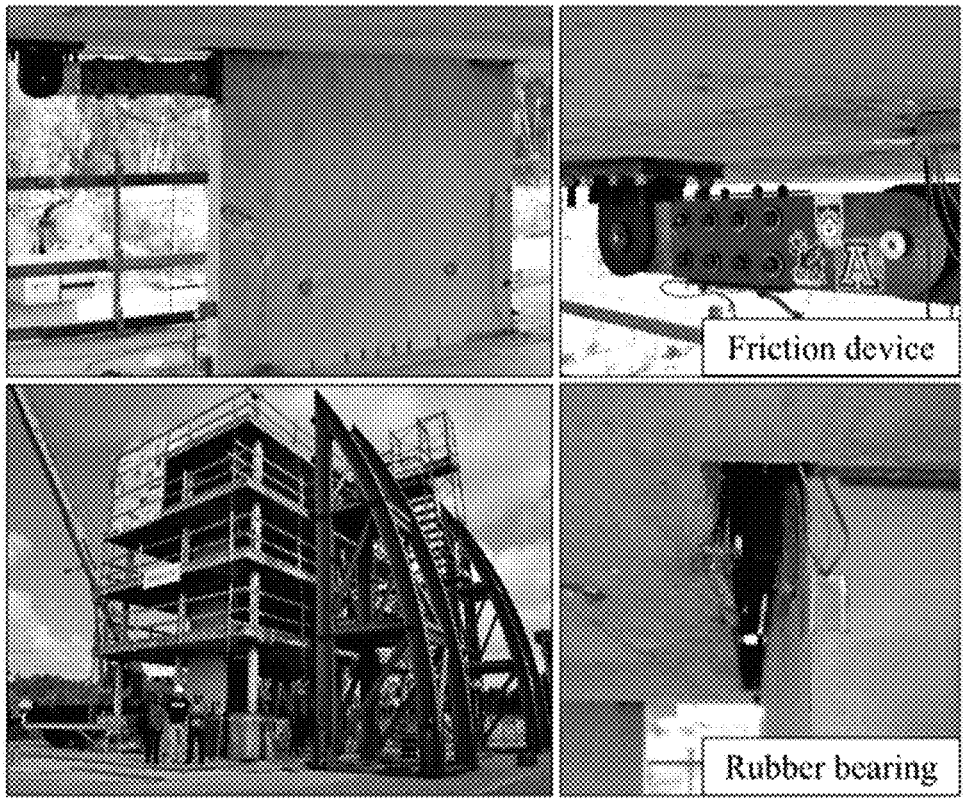

FIG. 3 shows an example force-limiting connection that includes a friction device and low-damping rubber bearings installed in an example building with rocking walls. Specifically, FIG. 3 shows example force-limiting connections between floors and planar seismic force-resisting systems that can limit the contribution of higher-mode responses in the total dynamic response of the building and effectively reduce the variability in the seismic response of buildings due to the ground motion variability. FIG. 3(*a*) illustrates a friction device developed for force-limiting connections. FIG. 3(*b*) illustrates example of force-limiting connections in a building with planar rocking walls. Studies on the seismic response of buildings with force-limiting connections between gravity load resisting systems and reinforced concrete planar walls, planar rocking walls, and self-centering concentrically braced steel frames indicate that the use of force-limiting connections in these buildings may (1) limit the seismic induced force and acceleration responses, (2) reduce the variability in the force and acceleration responses due to the ground motion variability, and/or (3) mitigate the effects of higher-mode responses on the dynamic response of buildings. Buildings with dissipative floor connectors between the gravity load resisting system and steel concentrically braced frames may exhibit similar seismic response. A dissipative floor connector may include one or more rubber bearings and a friction device.

Friction devices can be designed to be axially stiff, compact, and easy to manufacture and assemble. The design of friction devices is not limited by strain requirements similar to the strain requirements used in the design of metallic yielding devices. However, the friction force generated by a friction device may depend on or relate to one or more of the materials used in the frictional interface, the sliding velocity, the cumulative sliding, the dwell time, and the manufacturing tolerances of the components of the friction device. Friction devices can remain undamaged during earthquakes, and they can be reused. Friction devices may be used in various structural applications. For example, a static load control friction device may be used to limit the effect of differential settlement that occurs at foundations. As another example, friction devices may be used for energy dissipation in various types of earthquake-resistant structures, such as bridge structures, precast concrete structures, wall pier coupling beams, steel braced frames, steel moment resisting frames, self-centering moment resisting frames, and rocking timber shear walls. Examples friction devices include a friction damper, a negative stiffness friction damper, a self-centering brace with friction-based energy dissipation, etc.

A reinforced concrete core wall system may be used as a seismic force-resisting system for tall buildings because of its high lateral stiffness and its capacity for dissipating energy. In addition to reinforced concrete, core walls can also be formed using cross-laminated timber structural walls or concrete filled composite plate structural walls. In contrast to planar seismic force-resisting systems that are not stable out-of-plane if they are not braced, core walls may be stable without lateral bracing. In the core wall system, the wall piers may be connected by reinforced concrete coupling beams along the height of the structure. The core wall system may be designed in a way that the nonlinear inelastic mechanism takes place at the coupling beams and at the base of the walls, with the rest of the structure designed to remain linear elastic. Similar to buildings with planar seismic force-resisting systems, the inelastic response at the core wall base may reduce the first mode response. However, the higher-mode effects are not reduced by the inelastic response at the wall base and they may amplify the seismic induced story shear forces and floor accelerations.

Figure 4:
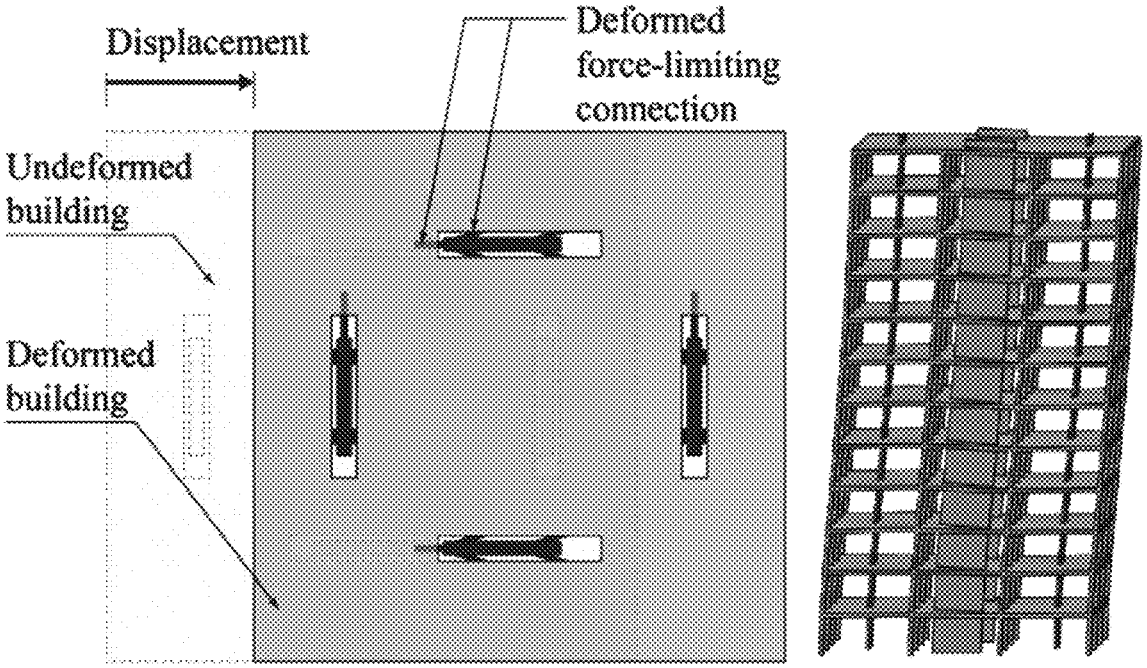
FIG. 4 illustrates a relative movement between the floors and the core wall system that may be constrained by the rubber bearings.
Figure 4:
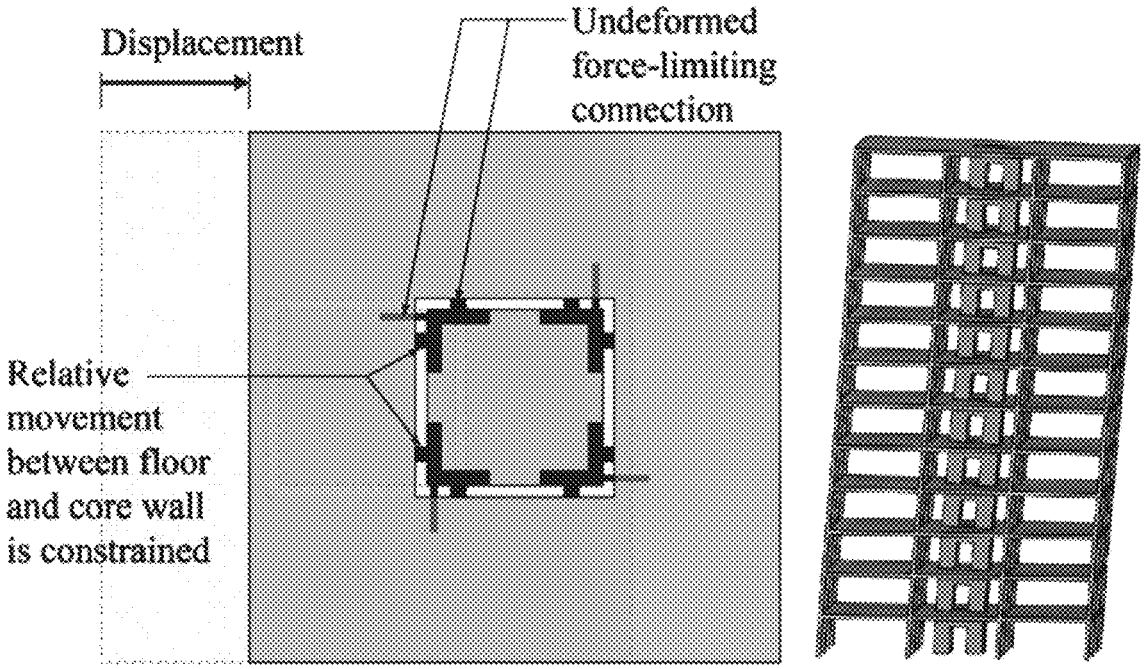

Force-limiting connections between the floors of the flexible gravity load resisting system and the stiff core wall may be used to mitigate the higher-mode effects on the dynamic response of tall buildings and contribute to the accelerated post-earthquake recovery of these buildings to a target level of functionality. However, the use of the force-limiting connections developed for buildings with planar walls in buildings with core walls may need to consider that the three-dimensional kinematic requirements in force-limiting connections between the floors and the core wall are different from the three-dimensional kinematic requirements in force-limiting connections between floors and planar walls. The high stiffness of the rubber bearings under compression may constrain the relative movement between the floors and the core wall, making the force-limiting connection ineffective, as shown schematically in FIG. 4. Specifically, FIG. 4 shows, in contrast with a planar wall system, the relative movement between the floors and the core wall system is constrained by the rubber bearings. The planar wall system is shown in FIG. 4(*a*) and the core wall system is shown in FIG. 4(*b*).

In an existing force-limiting connection for planar wall buildings, the functions of rubber bearings may (1) to provide out-of-plane stability to the planar walls and/or (2) to provide post-elastic stiffness to the force-limiting connection to prevent the potentially excessive connection deformation. Pounding of the slabs and the planar walls may occur at the maximum-considered-level of earthquake ground motion. Rubber bumpers may be used to transfer the pounding forces. The rubber bumpers may be used in addition to the friction devices and the low-damping rubber bearings. The use of conventional friction devices with constant force transferred between the floors of the flexible gravity load resisting system and the stiff core wall without the use of low-damping rubber bearings and bumpers may result in large displacement of the floor relative to the core wall and potentially uncontrolled pounding forces at the maximum-considered-level of earthquake ground motions.

Considering the above and other issues related to the use of an existing force-limiting connections in core wall buildings, there is a need for a structural connection that can develop predetermined forces at target design displacement levels with goal to limit the force and acceleration responses of core wall buildings without inducing excessive displacement demand in the connections.

Some embodiments of the present patent document relate to a simple and practical structural connection configured to develop predetermined discrete variable friction forces at target design displacement levels. As a result, a performance-based discrete variable limiting force-displacement response can be achieved. The connection may also be termed Modified Friction Device (Modified FD). The Modified FD may achieve a positive effective post-elastic stiffness through the discrete variable friction force instead of the constant friction force expected in conventional friction devices. In the following sections, the components and the assembly of the Modified FD are discussed. The mechanics of the Modified FD are described. Some embodiments of the present patent document include static structural analyses of two types of finite element models of the Modified FD. The first model uses solid finite elements and is termed Solid Model. The Solid Model is used to assess kinematics and force-displacement response of the Modified FD. The second model uses a truss finite element and is termed Truss Model. The Truss Model can be used to efficiently simulate the force-displacement response of the Modified FD in numerical earthquake simulations of structural systems. The force-displacement response of the Modified FD computed using a numerical earthquake simulation of an eighteen-story reinforced concrete core wall building model is presented for illustration purposes (and not intended to be limiting). The seismic response of the building model with Modified FDs may be compared with the seismic response of the building model with monolithic connections and the seismic response of the building model with friction devices with constant friction forces. The results presented herein show that the structural connection as disclosed herein may produce discrete variable force-displacement response to dissipate seismic energy and/or limit the seismic induced horizontal forces, e.g., those transferred between the floors of the flexible gravity load resisting system and the core wall piers in high-performance earthquake resilient buildings.

Figure 5:
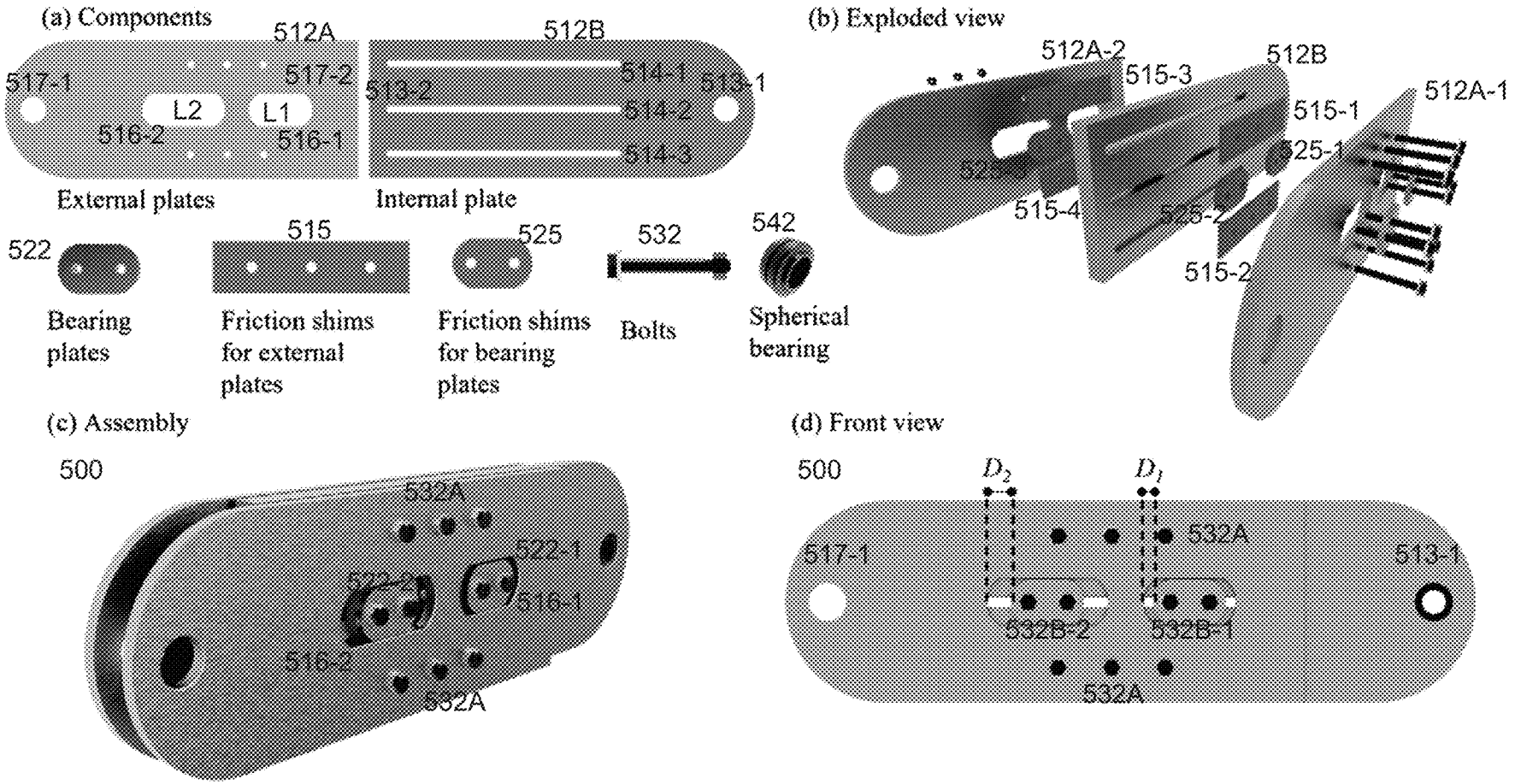
FIG. 5 illustrates various views of the friction device 500 according to some embodiments of the present document.
Figure 6:
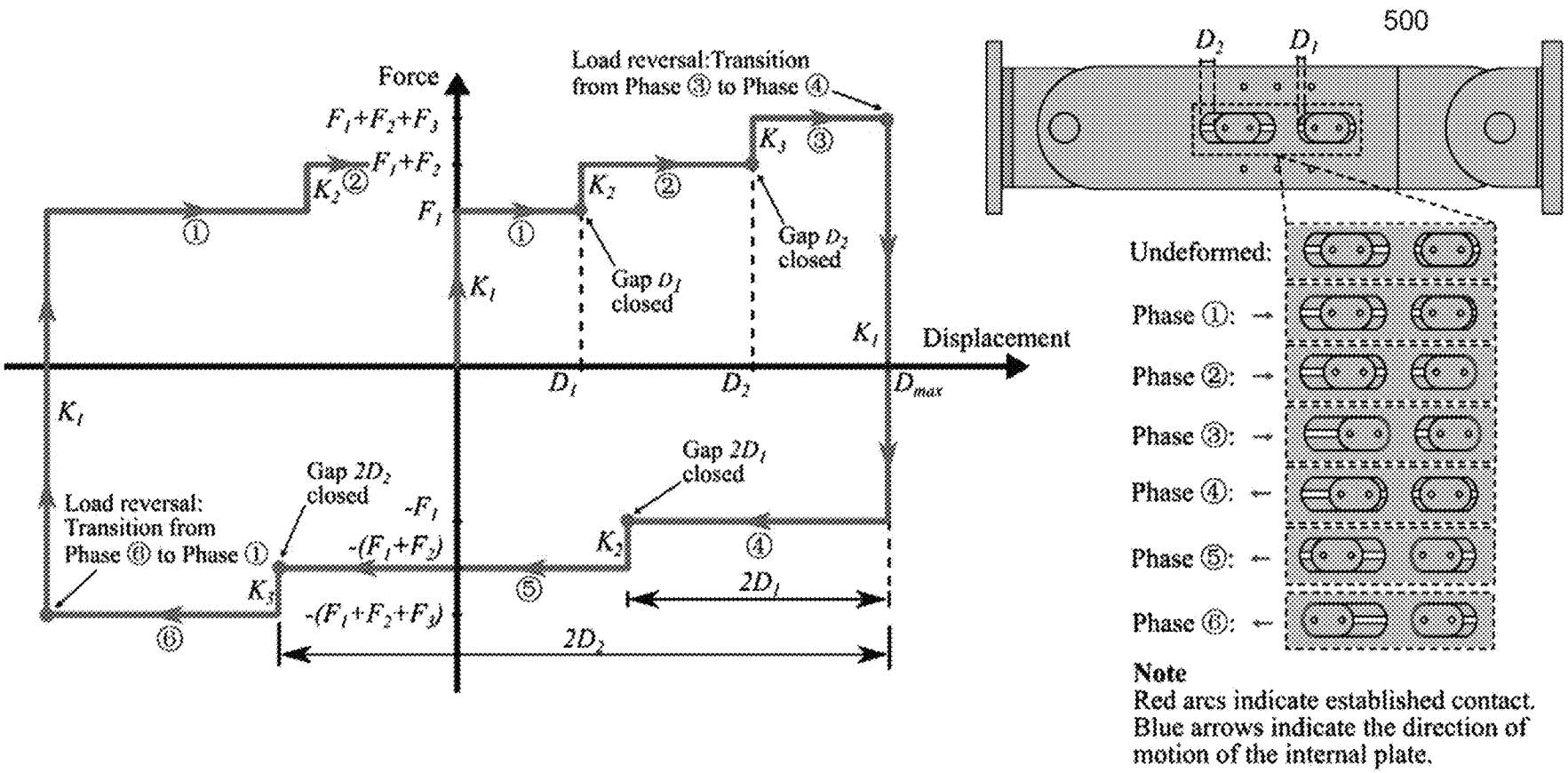
FIG. 6 shows example kinematics and force-displacement response of a friction device according to some embodiments of the present document.
Figure 7:
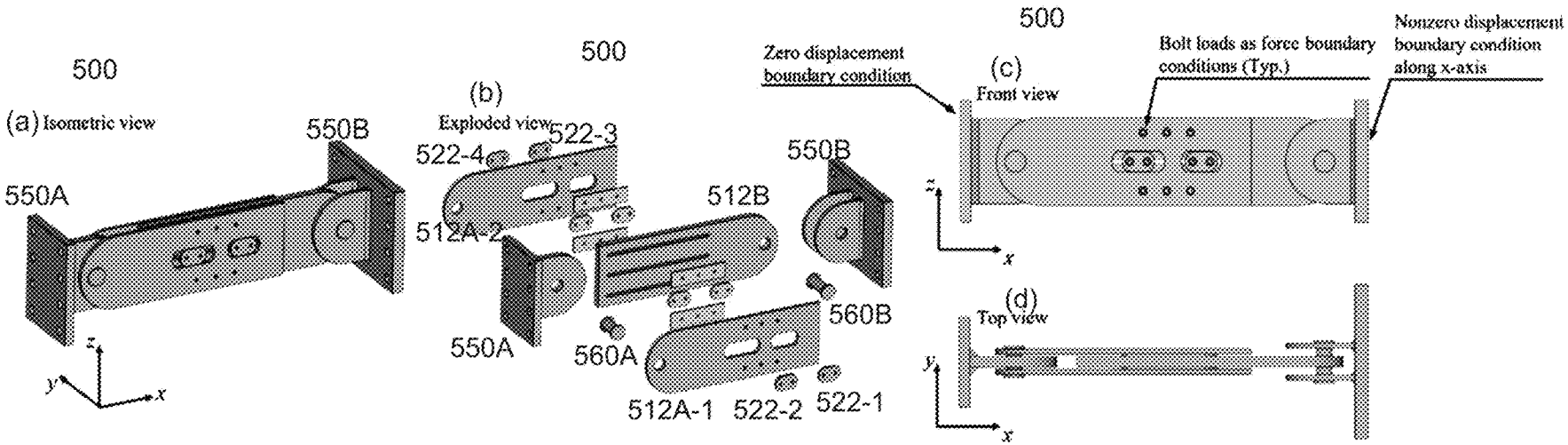
FIG. 7 shows the undeformed geometry of the Solid Model for a friction device in its isometric view (a) developed in ANSYS Mechanical finite element software and its exploded view (b), front view (c), and top view (d) according to some embodiments of the present document.

In some embodiments, a friction device for dissipating energy is provided. As illustrated in FIGS. 5 and 7, the friction device 500 may include a first friction assembly and a second friction assembly. The first friction assembly may include a first plate (e.g., external plate 512A) and a second plate (e.g., internal plate 512B). The first friction assembly may include one or more additional plates. For example, the first friction assembly may include three plates, including two external plates 512A-1 and 512A-2 and an internal plate 512B positioned between the two external plates 512A-1 and 512A-2, as illustrated in FIGS. 5-7. The first friction assembly may be configured to generate a first friction force by a movement of the first plate relative to the second plate. The first plate and the second plate may be spaced apart by one or more friction shims 515 (individually identified as 515-1 through 515-4, collectively 515). The friction shims 515 may be stationary relative to the second plate and move relative to the second plate so as to form a sliding interface (also referred to as friction interface) with the second plate when the first plate moves relative to the second plate. The second friction assembly may include one or a plurality of friction components (also referred to as auxiliary pads). A friction component or auxiliary pad may include a bearing plate 522 and a friction shim 525. The friction shim 525 (individually identified as 525-1 through 525-3, collectively 525) may be stationary relative to the bearing plate 522 so that the friction component may move as an integrated piece. The friction shim 525 of the friction component may move relative to the second plate so as to form a sliding interface with the second plate when the friction component moves relative to the second plate. As described below, the friction component may move only when it is coupled to the first plate. As illustrated in FIG. 6, a friction component may become coupled to the first plate in response to a movement of the first plate that exceeds a predetermined value. The second friction assembly may be configured to generate a second friction force by a movement of one or more of the plurality of friction components relative to the second plate when the one or more of the plurality of friction components are coupled to the first plate (e.g., in response to a movement of the first plate that exceeds a predetermined value). The friction device may include a fastener system configured to exert a normal force on the first friction assembly and/or the second friction assembly. For example, the fastener system may include a first fastener assembly configured to exert a first normal force onto the first friction assembly and a second fastener assembly configured to exert a second normal force onto the second friction assembly. The first friction force may depend on or otherwise relate to the first normal force. The second friction force may depend on or otherwise relate to the second normal force. The friction device may be configured to dissipate energy, e.g., seismic energy relating to a seismic event, by a total friction force that is a sum of the first friction force and the second friction force. In some embodiments, the fastener system may include a plurality of bolts 532 (individually identified as 532A and 532B (individually identified as 532B-1 and 532B-2 for bolts within opening 516-1 and 516-2 of an external plate 512A, respectively, collectively 532B), collectively 532). The fastener assembly may permit modulation of the normal force. For example, by adjusting one or more bolts, a corresponding normal force may be adjusted, and accordingly a corresponding friction force (e.g., the first friction force, the second friction force, the total friction force) may be adjusted. Additionally or alternatively, the total friction force may change by changing the total area of active sliding interfaces in the first friction assembly and/or the second friction assembly that are involved in generating the total friction force. A sliding interface, also referred to as a friction interface, between a friction shim (e.g., 515, 525) and the second plate (e.g., the internal plate 512B as illustrated in FIG. 5) may be considered active when the friction shim is moving relative to the second plate. For example, the total area of the sliding interfaces of the friction device 500 may be adjusted by changing the number or count of the friction components of the second friction module that are moving relative to the second plate at a time point. The first friction force and/or the second friction force may be adjusted by changing the friction coefficient of a friction shim at a sliding interface with respect to the second plate. The friction device 500 may be configured to produce a total friction force whose value may discretely vary. The friction device 500 may be configured to be attached to a structure to dissipate energy, e.g., seismic energy relating to a seismic event, from the structure during or after the event. Various components of the friction device 500 may be replaceable so that the friction device 500 remain sound after an event such as earthquake. For example, after an earthquake, one or more friction shims 515/525 may be replaced, instead of the entire friction device 500 being replaced.

FIGS. 5 and 7 illustrate various views of the friction device 500 according to some embodiments of the present document. FIG. 5 shows a sketch of the components in (a), an exploded view in (b), the assembly in (c), and the front view of the friction device 500 (also referred to as a Modified FD). The friction device 500 may include an internal plate 512B, two external plates 512A (individually identified as 512A-1 and 512A-2, and collectively 512A), four bearing plates 522, four friction shims 515 between the external plates 512A and the internal plate 512B (termed friction shims for external plates), four friction shims 525 between the bearing plates 522 and the internal plate 512B (termed friction shims for bearing plates), ten structural bolts 532 (e.g., with flat washers and nuts), and a spherical bearing 542. The number of bearing plates 522, friction shims 515 and 525, and bolts 532 can be adjusted to achieve the variations of the predefined discrete variable friction force-displacement response discussed in the following sections. End clevises 550 (individually identified as 550A and 550B, and collectively 550) used to attach the friction device 500 on the structure (e.g., at the floor and the seismic force-resisting system, respectively) are shown in FIG. 7. One or more of the plates (e.g., the external plates 512A, the internal plate 512B, the bearing plates 522) and the clevises 550 may be made of a metal (e.g., a high-strength metal such as structural steel ASTM A572 Grade 50), an alloy, or a combination thereof. In some embodiments, one or more of the plates (e.g., the external plates 512A, the internal plate 512B, the bearing plates 522) may include an environment-resistant coating, e.g., a corrosion-resistant coating. The friction shims (e.g., 515, 525) may be made of a composite material including, e.g., a laminated glass fiber fabric with a graphite composite material.

In some embodiments, the friction device 500 may include a heat dissipation component. For example, at least one of the two external plates 512A or the internal plate 512B may include a pattern of grooves designed to enhance a dissipation of heat generated by a movement of at least one of the two external plates relatively to the internal plate. In some embodiments, the friction device 500 may be configured to be retrofit within existing structural connections without substantial modification to the structure.

Pretension load may be applied to the bolts 532 to attach the external plates 512A, the bearing plates 522 (individually identified as 522-1, 522-2, 522-3, and 522-4 as illustrated in FIG. 7, and collectively 522), the friction shims 515 and 525, and the internal plate 512B. The bolted components may create the assembly as illustrate in FIG. 5(*c*). Friction interfaces may be established in the contact surfaces between the internal plate 512B and the friction shims 515/525. The bolt load may result in normal force on the friction interfaces between the friction shims 515/525 and the internal plate 512B. The friction shims 515 for the external plates 512A may be stationary and not expected to move relative to the external plates 512A. The friction shims 525 for the bearing plates may be stationary and not expected to move relative to the bearing plates 522.

The internal plate 512B may include one or more slots 514 (individually identified as 514-1, 514-2, and 514-3, and collectively 514) may allow a relative movement (e.g., a longitudinal motion along the axis x as illustrated in FIG. 7) of the friction shims 515/525, the external plates 512A, and the bearing plates 522 with respect to the internal plate 512B. For example, the internal plate 512B has a plurality of slots 514 configured to guide the two external plates 512A moving relatively to the internal plate 512B, and each of the plurality of bolts 532 may be coupled to at least one of the plurality of slots 514 to clamp or attach the two external plates 512A such that the two external plates move substantially synchronously. As another example, a friction assembly includes two friction components (each including a friction shim 525 and a bearing plate 522) positioned on opposite sides of the internal plate 512B, and a fastener assembly (including, e.g., one or more bolts) may be configured to clamp or attach the two friction components such that the two friction components move substantially synchronously.

The bearing plates 522 and the associated friction shims 525 may be positioned within openings 516 (individually identified as 516-1 and 516-2, and collectively 516) in the external plates 512A, and the bearing plates 522 are not expected to move relative to the internal plate 512B until the bearing plates 522 are coupled to (e.g., in contact with) the external plates 512A. At least two of the openings 516 may have a same opening size. At least two of the openings 516 may have different opening sizes. As illustrated, the opening 516-1 has an opening size L1, and the opening 516-2 has an opening size L2, and L1 may be different from L2. A first gap distance between a bearing plate 522-1 and the opening 516-1 in an external plates 512A is termed D1, and a second gap distance between a bearing plate 522-2 and an opening 516-2 in an external plate 512A is termed D2, as shown in FIG. 5(*d*). D1 may be the same as or different from D2. By configuring the opening sizes and/or locations of the openings 516, respectively, different friction components (each including a friction shim 525 fixedly attached to a bearing plate 522) may become coupled to an external plate 512A and move relative to the internal plate 512B to contribute to the friction force generated in the friction device 500. Additional description in this regard may be found elsewhere in the present document. See, e.g., FIG. 6 and the description thereof.

An external plate 512A may include a first end 517-1 and a second end 517-2. The internal plate 512B may include a first end 513-1 and a second end 513-2. The second end 513-2 of the internal plate 512B may be positioned between the two external plates 512A. The internal plate 512B may be directly or indirectly attached or coupled to a first portion of the structure at first end 513-1. The external plate 512A may be directly or indirectly attached or coupled to a second portion of the structure at the first end 517-1. The first portion may move relative to the second portion of the structure due to existence of an energy, e.g., seismic energy relating to a seismic event. The first portion or the second portion of the structure may be a floor, a foundation, a wall, a beam, or a brace of the structure. Merely by way of example, the internal plate 512B may be directly coupled to the first portion of the structure, while the two external plates 512A may be coupled to a seismic force-resisting system that is attached to the second portion of the structure. The spherical bearings 542 at the end (end 513-1 of the internal plate 512B, end 517-1 of an external plate 512A) of the friction device 500 and the clevis 550 allow rotational motions and restrain the translational motions within the plane of the plates (512A, 512B). Pins 560 (individually identified as 560A and 560B, and collectively 560) may be inserted through the spherical bearings 542 to couple the ends of the friction device 500 to the clevis 550. As a result, the friction device 500 may develop an axial load along its longitudinal direction (indicated by the axis x as illustrated in FIG. 7) and zero moments at the ends.

FIG. 6 shows example kinematics and force-displacement response of the friction device 500 according to some embodiments of the present document. For ease of description and not intended to be limiting, the illustrated kinematics and the force-displacement response relate to the following parameters: the first gap between the bearing plates 522-1 and the opening 516-1 in each external plate 512A is termed D1; the second gap between the bearing plates 522-2 and the opening 516-2 in each external plate 512A is termed D2; the friction force generated by the frictional interface between the internal plate 512B and the friction shims 515 for the external plates 512A is termed F1; the friction force generated by the frictional interface between the internal plate 5126 and the friction shims 525 for the bearing plates 522-1 in the openings 516-1 associated with D1 is termed F2; the friction force generated by the frictional interface between the internal plate 512B and the friction shims 525 for the bearing plates 522-2 in the opening 516-2 associated with D2 is termed F3; and the elastic stiffnesses are termed K1, K2, and K3. K1 relates to the flexibility of the components of the friction device 500 that are designed to have a linear elastic force-displacement response, and the shear flexibility of the friction shims 515 associated with external plates 512A. The linear elastic components include the clevis plates 550, the external plates 512A, the internal plate 512B, and the pins 560. K2 and K3 relate to the flexibility of the components of the friction device 500 that are designed to have a linear elastic force-displacement response, the shear flexibility of the friction shims 525 associated with D1 and D2, respectively. The kinematics of the friction device 500 may be illustrated as six phases that result in the force-displacement response. As illustrated in FIGS. 6 and 7, the translational motion of the external plates 512A may restrained (i.e., pinned condition at the ends of the external plates) and a displacement along the longitudinal direction (indicated by the axis x as illustrated in FIG. 7) of the friction device 500 may be applied at the end 513-1 of the internal plate 512B. Positive displacement may result in axial tension in the friction device 500 and negative displacement may result in axial compression in the friction device 500. The following section presents the six phases. For ease of description and not intended to be limiting, the discussion of the kinematics in the six phases ignores the elastic deformations F1/K1, F2/K2, and F3/K3 assuming K1=K2=K3≅∞. The rigid body kinematics of the friction device 500 components are considered.

Phase 1—Sliding along the positive direction of motion with friction force F1 The increase of the imposed displacement in the friction device 500 results in increasing force with stiffness K1. The imposed displacement may be due to a relative movement between different portions of a structure (e.g., a wall vs. a floor of a building, different beams of a bridge, different braces of a wind turbine) where the friction device 500 is attached to on the ends 517-1 of the external plates 512A and 513-1 of the internal plate 512B. The relative movement between the different portions of the structure may be caused energy imposed on the structure (e.g., seismic energy relating to a seismic event imposed on the building, wind energy from wind to a wind turbine). When the force in the friction device 500 becomes equal to F1, the friction shims 515 for the external plates 512A and the external plates 512A start moving relative to the internal plate 512B. The sliding at the frictional interface between the internal plate 512B and the friction shims 515 for the external plates 512A results in F1. F1 can be estimated using Coulomb theory, $F1=n_sN_1\mu_{s1}$, where $n_s=2$ is the number or count of friction interfaces; $N_1$ is the total load from the six bolts 532A acting normal to the friction interfaces between the friction shims 515 for the external plates 512A and the internal plate 512B; psi is the coefficient of friction in the friction interfaces between the friction shims 515 for the external plates 512A and the internal plate 512B. The total friction force in the friction device 500 during this phase is F1. The active friction interfaces in this phase include those between the friction shims 515 for the external plates 512A and the internal plate 512B.

Phase 2—Sliding along the positive direction of motion with friction force F1+F2: Assuming K1≅∞, once the value of displacement reaches D1, the external plates 512A contact or become coupled to the bearing plates 522-1 located in the opening 516-1 associated with D1. As the displacement in the friction device 500 increases, the force in the friction device 500 increases with stiffness K2. When the force in the friction device 500 becomes equal to F1+F2, the bearing plates 522-1 and the friction shims 525 in the openings 516-1 associated with D1 start moving relative to the internal plate 512B. The sliding at the frictional interface between the internal plate 512B and the friction shims 525 in the openings 516-1 associated with D1 results in F2. F2 can be estimated using Coulomb theory, $F2=n_sN_2\mu_{s2}$, where $N_2$ is the total load from the two bolts 532B-1 acting normal to the friction interfaces between the friction shims 525 in the openings 516-1 associated with D1 and the internal plate 512B; $\mu_{s2}$ is the coefficient of friction in the friction interfaces between the friction shims 525 in the openings 516-1 associated with D1 and the internal plate 512B. The total friction force in the friction device 500 during this phase is F1+F2. The total friction force in this phase is higher than in phase 1 at least partially because of an increase in the total area of active friction interfaces involved, which in turn is caused by the friction shims 525 in the openings 516-1 becoming coupled to the external plates 512A and moving relative to the internal plate 512B compared to phase 1.

Phase 3—Sliding along the positive direction of motion with friction force F1+F2+F3: Assuming K1=K2≅∞, once the value of the displacement reaches D2, the external plates 512A contact or become coupled to the bearing plates 522-2 located in the openings 516-2 associated with D2. As the displacement in the friction device 500 increases, the force in the friction device 500 increases with stiffness K3. When the force in the friction device 500 becomes equal to F1+F2+F3, the bearing plates 522-2 and the friction shims 525 in the openings 516-2 associated with D2 start moving relative to the internal plate 512B. The sliding at the frictional interface between the internal plate 512B and the friction shims 525 in the openings 516-2 associated with D2 results in F3. F3 can be estimated using Coulomb theory, $F3=n_sN_3\mu_{s3}$, where $N_3$ is the total load from the two bolts 532B-2 acting normal to the friction interfaces between the friction shims 525 in the opening 516-2 associated with D2 and the internal plate 512B; psi is the coefficient of friction in the friction interfaces between the friction shims 525 in the openings 516-2 associated with D2 and the internal plate 5126. The total friction force in the friction device 500 during this phase is F1+F2+F3. The motion continues until the friction device 500 reaches the maximum imposed displacement Dmax. The total friction force in this phase is higher than in phase 2 at least partially because of an increase in the total area of active friction interfaces involved, which in turn is caused by more friction shims 525 in the openings 516-2 becoming coupled to the external plates 512A and moving relative to the internal plate 512B than in phase 2.

Phase 4—Sliding along the negative direction of motion with friction force −F1: The reversal of the imposed displacement reduces the force in the friction device 500 with elastic stiffness K1. When the force in the friction device 500 becomes equal to −F1, the internal plate 512B starts moving relative to the external plates 512A along the negative direction (e.g., the negative of the axis x as illustrated in FIG. 7). The friction shims 525 for the bearing plates are not expected to move relative to the internal plate 512B during this phase. The internal plate 512B moves relative to the friction shims 515 for the external plates 512A and the external plates 512A, resulting in a total friction force with magnitude equal to F1. The total friction force in this phase is lower (in magnitude) than in phase 3 at least partially because of a decrease in the total area of active friction interfaces involved, which in turn is caused by friction shims 525 in the openings 516-2 becoming decoupled to the external plates 512A and not moving relative to the internal plate 512B than in phase 3.

Phase 5—Sliding along the negative direction of motion with friction force −(F1+F2): Assuming K1≅∞, once the value of displacement reaches Dmax−2D1, the external plates 512A contact or become coupled to the bearing plates 522-1 located in the opening 516-1 associated with D1. As the displacement in the friction device 500 decreases, the force in the friction device 500 decreases with stiffness K2.

When the force in the friction device 500 becomes equal to −(F1+F2), the internal plate 5126 starts moving relative to the bearing plates 522-1 and the friction shims 525 in the opening 516-1 associated with D1. The sliding at the friction interface between the internal plate 512B and the friction shims 525 in the openings 516-1 associated with D1 results in a force with magnitude equal to F2. The total friction force in the friction device 500 during this phase is −(F1+F2). The total friction force in this phase is higher (in magnitude) than in phase 4 at least partially because of an increase in the total area of active friction interfaces involved, which in turn is caused by friction shims 525 in the openings 516-1 becoming coupled to the external plates 512A and moving relative to the internal plate 512B than in phase 4.

Phase 6—Sliding along the negative direction of motion with friction force −(F1+F2+F3): Assuming K1=K2≅∞, once the value of displacement reaches Dmax−2D2, the external plates 512A contact or become coupled to the bearing plates 522-2 located in the openings 516-2 associated with D2. As the displacement in the friction device 500 decreases, the force in the friction device 500 decreases with stiffness K3. When the force in the friction device 500 becomes equal to −(F1+F2+F3), the internal plate 512B starts moving relative to the bearing plates 522-2 and the friction shims 525 in the openings 516-2 associated with D2. The sliding at the frictional interface between the internal plate 512B and the friction shims 525 in the openings 516-2 associated with D2 results in a force with magnitude equal to F3. The total fiction force in the friction device 500 during this phase is −(F1+F2+F3). The total friction force in this phase is higher (in magnitude) than in phase 5 at least partially because of an increase in the total area of active friction interfaces involved, which in turn is caused by friction shims 525 in the openings 516-2 becoming coupled to the external plates 512A and moving relative to the internal plate 512B than in phase 5.

Finite element analyses can be used for rapid digital prototyping of the friction device 500. For illustration purposes and not intended to be limiting, the Solid Model and the Truss Model described elsewhere in the present document are used in static structural analyses. The Solid Model is used to assess the kinematics and the force-displacement response of the friction device 500. The Truss Model is used to simulate the force-displacement response of the friction device 500 in numerical earthquake simulations of structural systems.

FIG. 7 shows the undeformed geometry of the Solid Model for the friction device 500 in its isometric view (a) developed in ANSYS Mechanical finite element software and its exploded view (b), front view (c), and top view (d). The Solid Model explicitly simulates the internal plate 512B, the external plates 512A, the bearing plates 522, the friction shims 515/525, the clevises 550, and the pins 560 using 24,962 eight-node solid finite elements. In this example model, the overall lengths (i.e., their longest dimensions along the x-direction) of the external plates are 122.56 cm, their thicknesses (i.e., their dimensions along the y-direction) are 2.54 cm and their heights (i.e., their dimensions along the z-direction) are 41.91 cm; the overall length of the internal plate is 127.64 cm, its thickness is 5.08 cm and its height is 41.91 cm; the overall lengths of the bearing plates are 15.56 cm, their thicknesses are 1.52 cm and their heights are 9.68 cm; the dimensions of the friction shims for the external plates are 38.1 cm×1.02 cm×10.16 cm (x×y×z); the overall lengths of the friction plates associated with the bearing plates are 15.56 cm, their thicknesses are 2.03 cm and their heights are 9.68 cm; the diameters of both pins are 7.8 cm. The bolts are assumed to be ASTM A325 structural bolts with a diameter of 19.05 mm. The minimum pretension of each bolt is 124.55 kN. ASTM A572 Grade 50 is considered for the steel plates. The Solid Model does not explicitly simulate the bolts and the associated washers and nuts used to apply the normal force on the friction interfaces. The preload of the bolts is simulated as a constant force boundary condition distributed to the nodes on the surface of the elements in the external plates and the bearing plates. The simulated bolt load is applied at the friction shims 515/525 between the internal plate 512B and the external plates 512A and also between the internal plate 512B and the bearing plates 522, and they represent the common surface areas between the washers and the external plates and the common surface areas between the washers and the bearing plates 522. Zero displacement boundary condition is enforced at all the degrees of freedom of the nodes located on the surface of the single clevis located closer to the origin of the global x-axis. In a building application, the single clevis would have been attached to a core wall pier. As a result, the enforced boundary condition is a simplification. The simplified boundary condition is acceptable considering that the objective of the analysis of the Solid Model is to assess the expected kinematics and the expected force-displacement response of the friction device 500. For the same reason, simplified nonzero displacement boundary condition is enforced at the degrees of freedom along the global x-axis of the nodes on the surface of the double clevis further away from the origin of the global x-axis.

The Solid Model explicitly simulates the contact interfaces between the modeled components of the friction device 500 using pair-based contact definition with 44,805 surface-to-surface contact elements. A contact pair is defined between each curved surface of a bearing plate 522 and the adjacent curved surface in the opening 516 of the external plate 512A. These contact pairs are assumed to be frictionless. A contact pair is defined between each surface of the friction shims 515 and the adjacent surface of the internal plate 512B. The stress normal to the surfaces is related to the shear stress that defines the limit for the initiation of sliding using the Coulomb friction model with a constant friction coefficient equal to 0.4. The assumed friction coefficient is based on past experimental observations of a friction device with friction interfaces established between steel and laminated glass fiber fabric with graphite composite friction shims. The friction shims are assumed to be bonded on the bearing plates and the external plates. This assumption is based on consideration that the bearing action of the bolts on the friction shims enforces the kinematic compatibility between the friction shims and the bearing plates and between the friction shims and the external plates. Past research has shown that it is possible to accomplish this kinematic compatibility without damaging the friction shims due to the expected bearing stresses acting on the friction shims. A contact pair is defined between each surface of the pins or bolts 532 and the surface of the internal plate 512B where bearing is expected to occur. Similarly, a contact pair is defined between each surface of the pins or bolts 532 and the surface of the external plates 512A where bearing is expected to occur. A constant friction coefficient equal to 0.3 is assumed for the steel pin 532 to steel plates (512A or 512B) contact interfaces. The components of the friction device 500 are designed to remain linear elastic. All materials are simulated using a linear elastic constitutive stress-strain relationship. The structural steel is assumed to have a modulus of elasticity equal to 200 GPa and a Poisson's ratio equal to 0.3. The composite friction material is assumed to have a modulus of elasticity equal to 6.9 GPa and a Poisson's ratio equal to 0.4.

The example parameters considered for the design of the friction device 500 used to develop the Solid Model are D1=2 cm, D2=5 cm, F1=600 kN, F2=200 kN, and F3=200 kN. The calculation of F1, F2, and F3 follows Coulomb theory, for example, $F_1=n_sN_1\mu_{s1}$, where $n_s=2$ is the number or count of friction interfaces; $N_1$ is the total load from the six bolts acting normal to the friction interfaces, $N_1=6\times 124.55$ kN=747.30 kN, given the minimum pretension of each bolt is 124.55 kN; $\mu_{s1}=0.4$ is the assumed coefficient of friction at the friction interface. Standard oversize holes were considered for all the pin holes. As a result, the difference between the nominal diameter of the holes and the nominal diameter of the pins or bolts is equal to $\Delta_{dn}=0.16$ cm=1/16 inches. A static structural analysis of the friction device 500 is performed and the stiffness matrix is updated at each converged step of analysis to account for the updated geometry. The results from the static structural analysis of the Solid Model are shown below.

Figure 8:
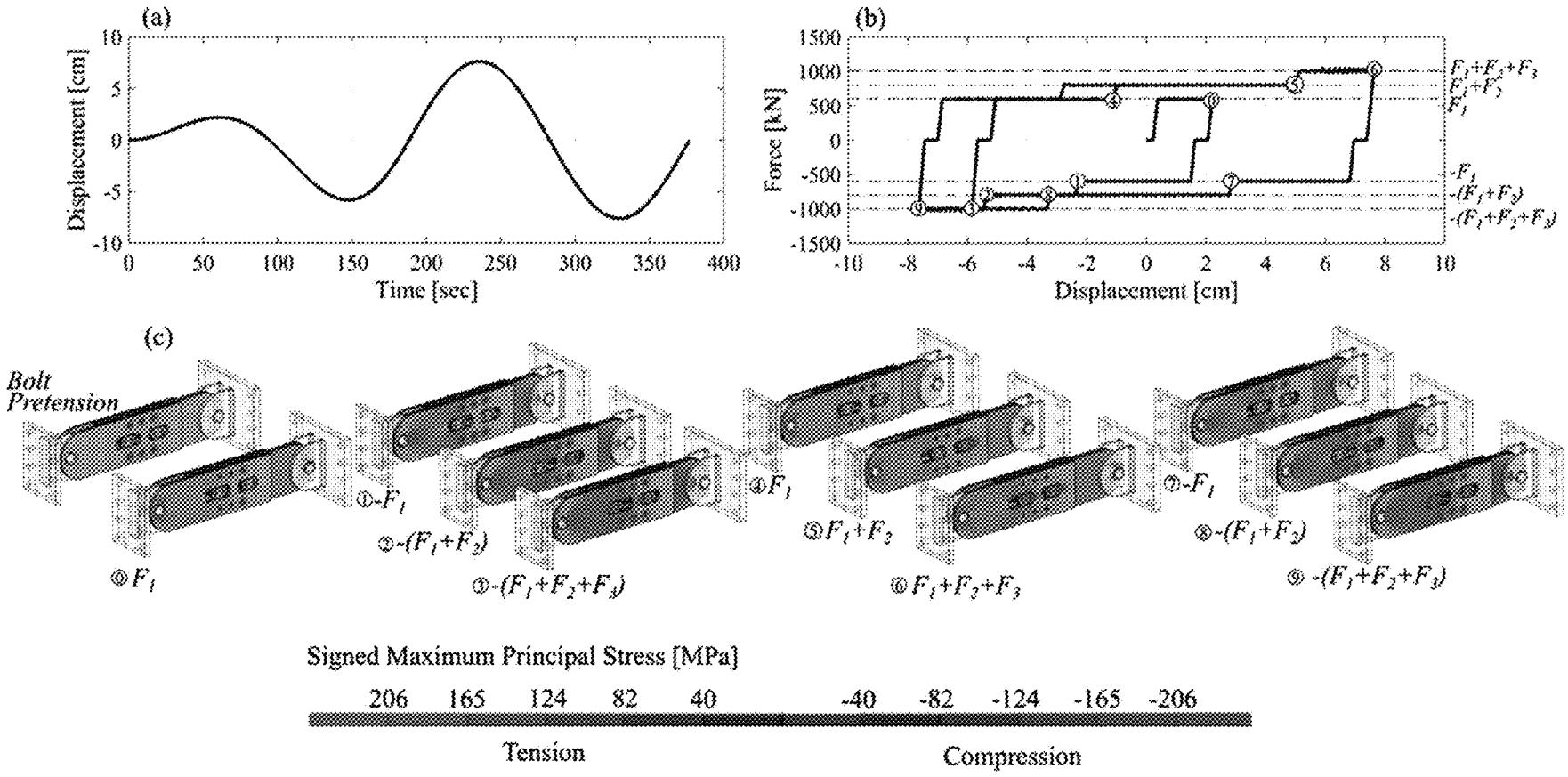
FIG. 8 illustrates results of static structural analysis of a Solid Model according to some embodiments of the present document.

Static structural analysis of the Solid Model is performed. The analysis is executed in two steps. Results from the analysis are shown in FIG. 8. The force boundary conditions that simulate the bolt pretension loads are applied in the first step of analysis. In the second step of analysis, the sinusoidal displacement shown in FIG. 8(*a*) is applied along the global x-axis at the degrees of freedom with the nonzero displacement boundary condition shown in FIG. 7. FIG. 8(*b*) shows the relationship of the applied displacement and the total reaction force along the global x-axis multiplied by −1. Positive force in the plot indicates tension in the Solid Model. The force-displacement relationship also shows the pinching displacement at zero force due to the difference between the nominal diameter of the holes and the nominal diameter of the pins. FIG. 8(*c*) shows the maximum principal stresses in the Solid Model at the first step of analysis and the ten sub-steps of the second step of analysis. In the first step, stresses develop in the Solid Model only due to the simulated bolt pretension. In the second step, the stress distribution at each sub-step is used to discuss the kinematics associated with the computed force-displacement response of the Solid Model. Sub-steps 0, 1, 4, and 7 are associated with force magnitude F1 since contact has not been established between the bearing plates and the external plates. The gap distance D1 has closed in sub-steps 2, 5, and 8. Two out of the four bearing plates are in contact with the two external plates. The increased magnitude of the maximum principal compressive stresses in the contact areas between two bearing plates and the two external plates is indicated with dark blue color as shown in FIG. 8(*c*). Sub-steps 2, 5, and 8 are associated with a force magnitude equal to F1+F2. The gap distance D2 has closed in sub-steps 3, 6, and 9. All bearing plates are in contact with the two external plates and high magnitude maximum principal compressive stresses are observed in the contact areas between the bearing plates and the external plates. Sub-steps 3, 6, and 9 are associated with a force magnitude equal to F1+F2+F3. The simulated kinematics and the computed force-displacement relationship verify that the friction device 500 as disclosed herein can develop predetermined discrete variable friction forces at target design displacements.

Figure 9:
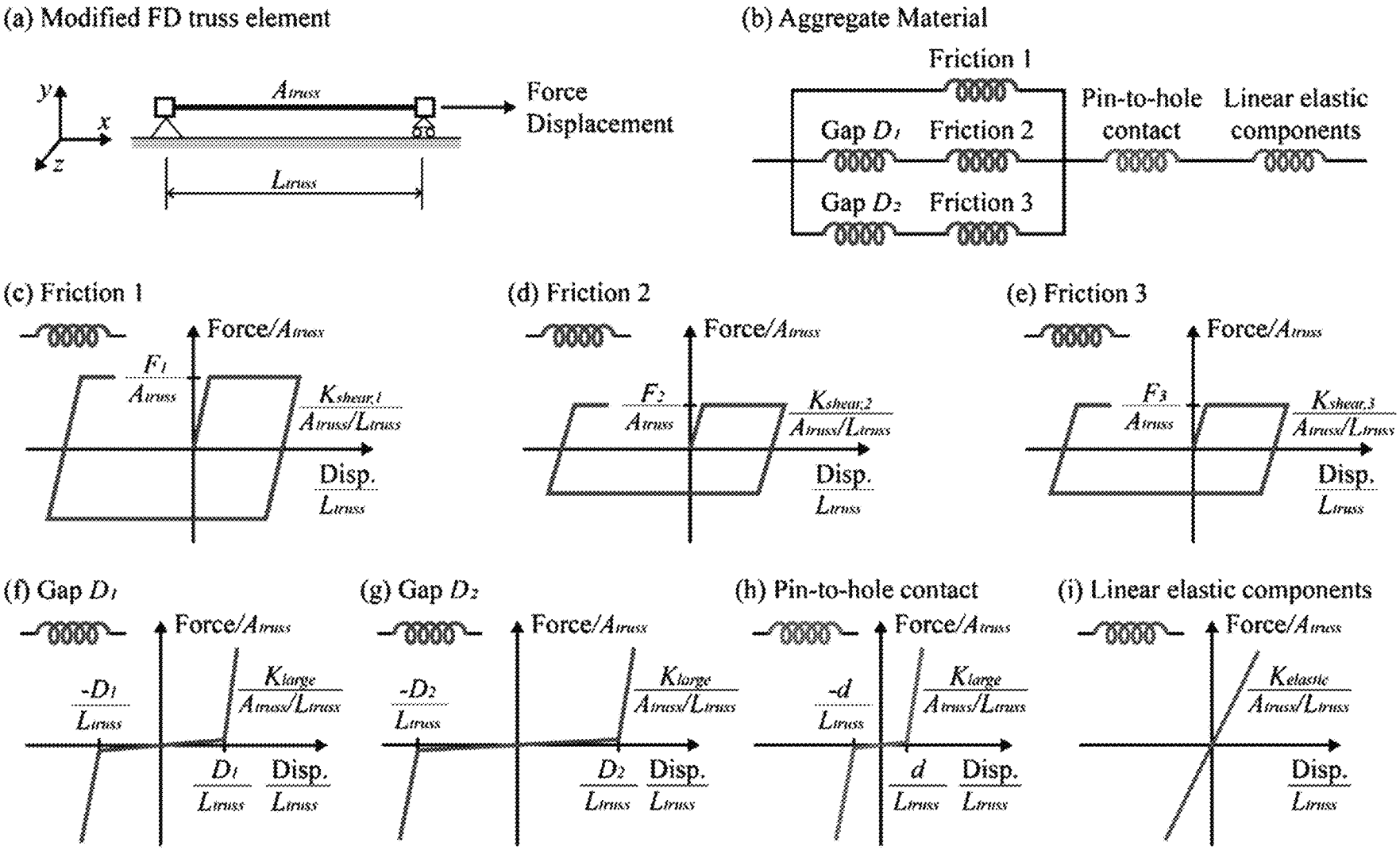
FIG. 9 illustrates schematic representation of a Truss Model for a friction device according to some embodiments of the present document.

The Truss Model simulates the force-displacement response of the friction device 500 in OpenSees using a corotational truss element. FIG. 9(*a*) shows the schematic representation of the Truss Model. A reference unit area is assigned to the truss element, termed Atruss. The length of the truss element is equal to the total approximate length of the friction device 500, termed Ltruss. A uniaxial material termed Aggregate Material is assigned to the truss element. The term "Aggregate" is used for the uniaxial material to indicate that its stress-strain relationship is simulated by combining the stress-strain relationships of seven primary uniaxial materials. The stress of the Aggregate Material is equal to the internal force in the truss element normalized by Atruss. The strain of the Aggregate Material is equal to the axial deformation of the truss element divided by Ltruss. The use of a normalized force-displacement response as the stress-strain relationship of a uniaxial material assigned to a truss element is a common modeling approach in OpenSees. FIG. 9(*b*) shows the schematic representation of the combination of the seven primary uniaxial materials used to develop the Aggregate Material. The primary uniaxial materials in FIG. 9(*b*) are represented as springs and their normalized force-displacement behavior as further described below.

The primary uniaxial materials termed Friction 1, Friction 2, and Friction 3 simulate the normalized force-displacement behavior of the frictional interfaces that result in F1, F2, and F3. The normalized force-displacement relationships of Friction 1, Friction 2, and Friction 3 are shown in FIG. 9(*c*), FIG. 9(*d*), and FIG. 9(*e*), respectively. Friction 1, Friction 2, and Friction 3 are modeled using the Steel01 uniaxial material in OpenSees. Their normalized elastic stiffness simulates the elastic shear stiffness of the friction shims:

$$K_{shear,i}=n_{fpi}\times G\times A_{fpi}/t_{fpi} \text{ normalized by } (A_{truss}/L_{truss}. \quad (1)$$

Figure 10:
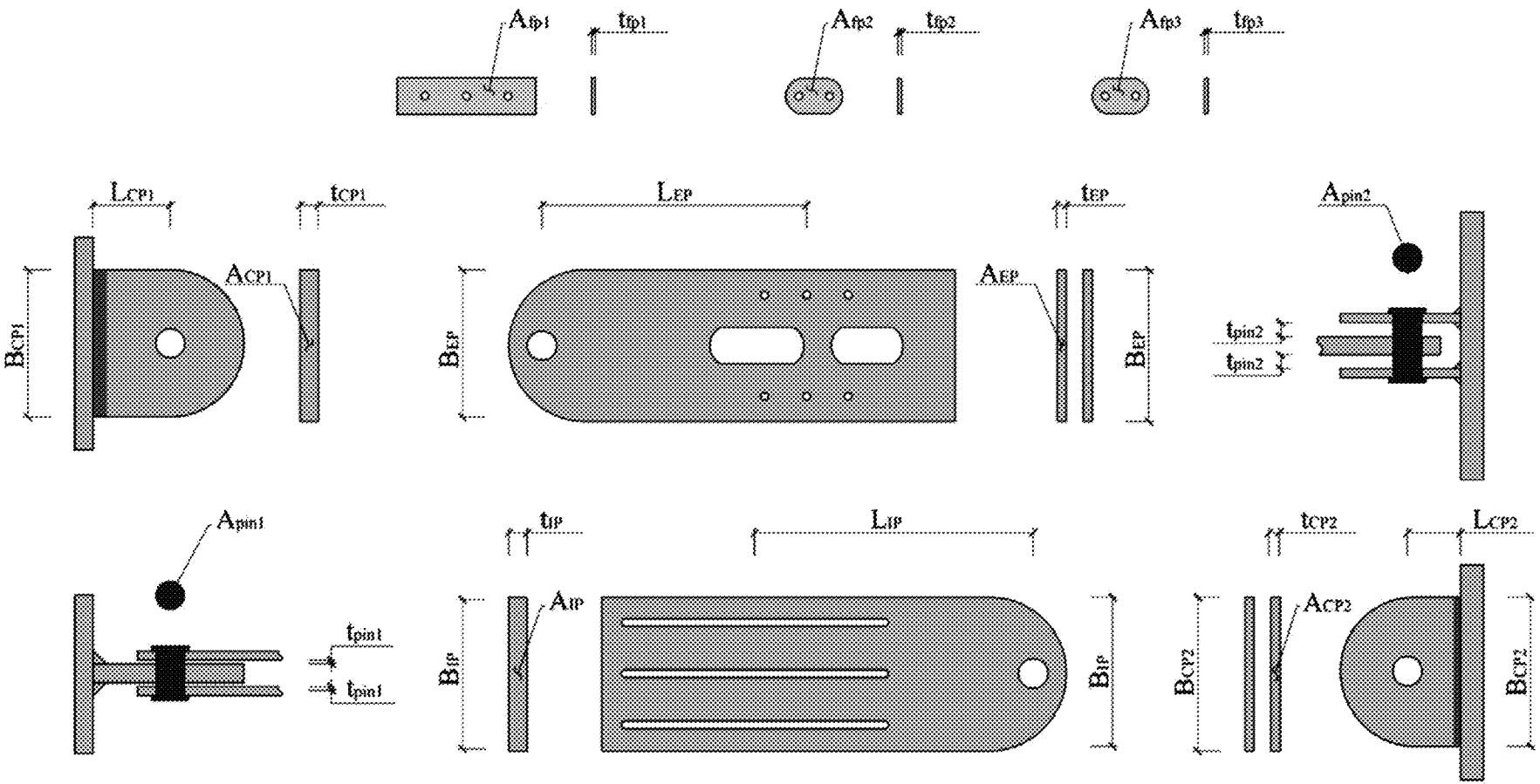
FIG. 10 illustrates schematic representation of the geometric terms used to estimate the stiffness of the components of a friction device simulated with the Truss Model according to some embodiments of the present document.

Parameters in Equation (1) are described as follows. The subscript i=1, 2, and 3 indicates the number associated with Friction 1, Friction 2, and Friction 3, respectively. $n_{fpi}$ is the number or count of friction shims associated with the development of the friction forces Fi. G is the expected shear modulus of the material of the friction shims assuming that the same material is used for all the friction shims. $A_{fpi}$ is the surface area of the associated friction shim. $t_{fpi}$ is the thickness of the associated friction shim. FIG. 10 shows the schematic representation of the geometric terms $A_{fpi}$ and $t_{fpi}$ for i=1, 2, and 3. The transition from the elastic to the post-elastic normalized force-displacement response simulates the slip between the friction shims and the internal plate associated with the friction force Fi for i=1, 2, and 3 normalized by $A_{truss}$.

The primary uniaxial materials, termed Gap D1 and Gap D2, simulate the contact behavior between the bearing plates 522 and the external plates 512A. They are modeled using the ElasticMultiLinear uniaxial material in OpenSees. The normalized force-displacement relationships of Gap D1 and Gap D2 are shown in FIGS. 9(*f*) and 9(*g*), respectively. The pinching displacement behavior at an approximately zero normalized force is simulated with a small, normalized stiffness relative to the normalized elastic stiffness of the friction device 500. The small, normalized stiffness is assigned to the normalized force-displacement region between the normalized gap lengths $-Dj/L_{truss}$ and $Dj/L_{truss}$ where j=1 or 2 indicates the gap distance D1 or D2, respectively. A large, normalized stiffness relative to the normalized elastic stiffness of the friction device 500 is used to simulate the normalized contact stiffness between the bearing plates and the external plates.

The primary uniaxial material, termed Pin-to-hole contact, simulates the contact behavior between the pins and associated holes in the clevises, the external plates, and the internal plates. FIG. 9(*h*) shows the normalized force-displacement relationship of the ElasticMultiLinear uniaxial material used to simulate this contact behavior. The pinching displacement behavior at an approximately zero normalized force is simulated with a small, normalized stiffness relative to the normalized elastic stiffness of the friction device 500. The small, normalized stiffness is assigned to the normalized force-displacement region between the normalized gap lengths:

$$-d/L_{truss}=-(4\times\Delta dn)/L_{truss}, \quad (2)$$

and $$d/L_{truss}=(4\times\Delta_{dn})/L_{truss}. \quad (3)$$

A large, normalized stiffness relative to the normalized elastic stiffness of the friction device 500 is used to simulate the contact stiffness between the pins, the devises, and the plates.

The primary uniaxial material, termed Linear Elastic Components, simulates the flexibility of the components of the friction device 500 that are designed to have a linear elastic force-displacement response. FIG. 9(*i*) shows the normalized force-displacement relationship of the Elastic uniaxial material used in OpenSees. The flexibility of the elastic components is estimated as a combination of the elastic components in series as follows:

$$1/K_{elastic}=1/K_{CP1}+1/K_{Pin1}+1/K_{EPs}+1/K_{IP}+1/K_{Pin2}+1/K_{CP2}, \quad (4)$$

where $K_{CP1}=E_{steel}\times A_{CP1}/L_{CP1}$ is the estimate of the axial stiffness of the single clevis plate; $K_{Pin1}=2\times G_{steel}\times A_{Pin1}/t_{Pin1}$ is the estimate of the shear stiffness of the pin connecting the external plates with the single clevis plate; $K_{EPs}=2\times E_{steel}\times A_{EP}/L_{EP}$ is the estimate of the axial stiffness of the two external plates; $K_{IP}=E_{steel}\times A_{IP}/L_{IP}$ is the estimate of the axial stiffness of the internal plate; $K_{Pin2}=2\times G_{steel}\times A_{Pin2}/t_{Pin2}$ is the estimate of the shear stiffness of the pin connecting the double clevis plate with the internal plate; $K_{CP2}=2\times E_{steel}\times A_{CP2}/L_{CP2}$ is the estimate of the axial stiffness of the double clevis plate. For all the terms above, A, L, and t relate to the size of components of the friction device 500 and the clevis plates 550. FIG. 10 shows the schematic representations of the geometric terms used to compute the estimate of the stiffness of each elastic component that was considered in the computation of the flexibility of the linear elastic components. $E_{steel}$ and $G_{steel}$ are the modulus of elasticity and the shear modulus of steel, respectively. The parameters for the example Solid Model for the friction device 500 discussed above are the following: for the structural steel, $E_{steel}$=200 GPa and $G_{steel}$=77 GPa; for the single clevis plate, $B_{CP1}$=40.64 cm, $t_{CP1}$=5.08 cm, $A_{CP1}=B_{CP1}\times t_{CP1}$=206.45 cm$^2$, and $L_{CP1}$=17.46 cm; for the pin connecting the external plates with the single clevis plate, $A_{Pin1}$=47.78 cm$^2$ and $t_{Pin1}$=1.27 cm; for the external plates, $B_{EP}$=41.91 cm, $t_{EP}$=2.54 cm, $A_{EP}=B_{EP}\times t_{EP}$=106.45 cm$^2$, and $L_{EP}$=72.64 cm; for the internal plate, $B_{IP}$=41.91 cm, $t_{IP}$=5.08 cm, $A_{IP}=B_{IP}\times t_{IP}$=212.9 cm$^2$, and $L_{IP}$=72.64 cm; for the pin connecting the double clevis plate with the internal plate, $A_{Pin2}$=47.78 cm$^2$, and $t_{Pin2}$=3.81 cm; for the double clevis plate, $B_{CP2}$=40.64 cm, $t_{CP2}$=2.54 cm, $A_{CP2}=B_{CP2}\times t_{CP2}$=103.23 cm$^2$, and $L_{CP2}$=14.61 cm.

Static structural analyses of the Truss Model are performed to compare the computed force-displacement response with the force-displacement response computed from the static structural analyses of the Solid Model. The axial degree of freedom at one node of the Truss Model is fixed. The displacement history shown in FIG. 8(*a*) is applied at the second axial degree of freedom of the Truss Model. The Truss Model assumes the design parameters considered in the Solid Model descried above: D1=2 cm; D2=5 cm; F1=600 kN; F2=F3=200 kN.

Figure 11:
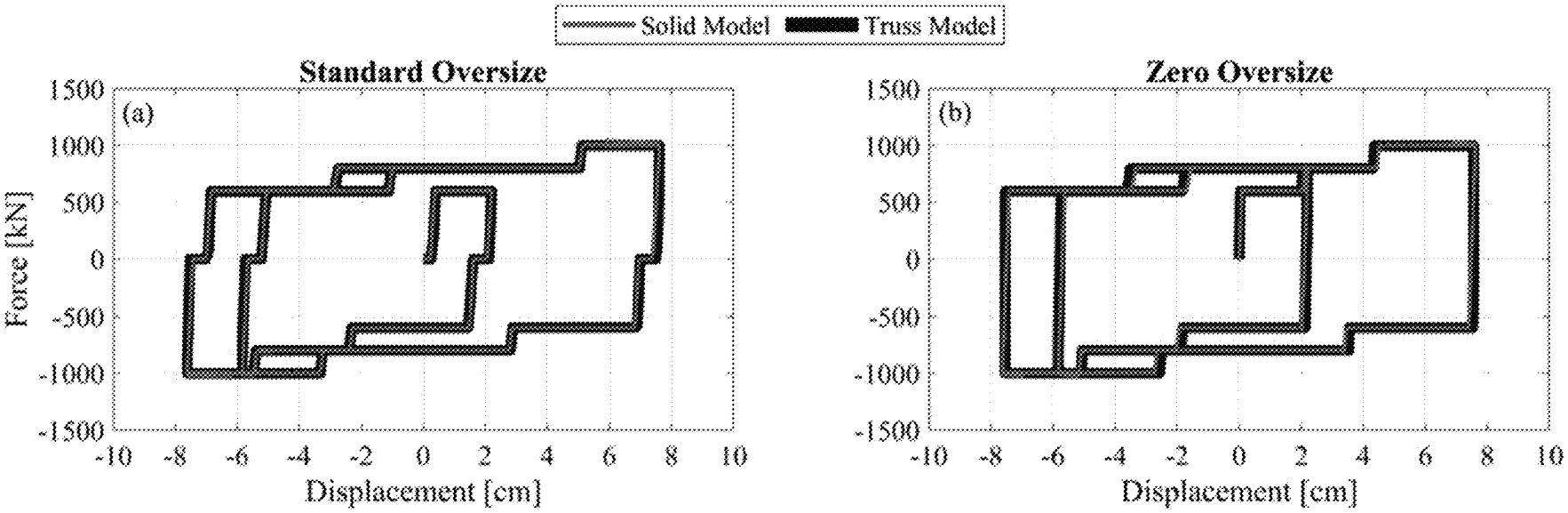
FIG. 11 illustrates comparison of the force-displacement response computed using the Solid Model and the Truss Model according to some embodiments of the present document.

FIG. 11 shows results from two analysis cases. The first analysis case assumes standard oversized pin holes with a 0.16 cm=1/16 inches difference between the diameter of the pin holes and the diameter of the pins. This analysis case is termed Standard Oversize. The second analysis case assumes a 0.00 cm difference between the diameter of the pin holes and the diameter of the pins. This analysis case is termed Zero Oversize. The Zero Oversize analysis case represents an ideal design case with machining requirements subjected to low tolerance. Low tolerance machining of the components of the friction device 500 can be accomplished by using Computer Numerical Control (CNC) subtracting manufacturing methods. FIG. 11(*a*) and FIG. 11(*b*) compare the force-displacement response of the Truss Model and the force-displacement response of the Solid Model for the Standard Oversize analysis case and the Zero Oversize analysis case, respectively. The comparison of the results shows that the Truss Model approximates reasonably well the force-displacement response computed using the Solid Model. Accordingly, the Truss Model can be used to simulate the force-displacement response of the friction device 500 in numerical earthquake simulations of core wall building models.

Five additional static structural analyses of the Truss Model are conducted to show the effect of the variation of the design parameters D1, D2, F1, F2, and F3 in the force-displacement response of the friction device 500. Table 1 lists the design parameters considered in the six analysis cases discussed in this section.

TABLE 1

Design parameters considered in six variations of the Truss Model

| | Case of Design Parameters | | | | |
|---|---|---|---|---|---|
| [—] | $D_1$ [cm] | $D_2$ [cm] | $F_1$ [kN] | $F_2$ [kN] | $F_3$ [kN] |
| Baseline Model | 2.00 | 5.00 | 600 | 200 | 200 |
| DP1 | 3.56 | 5.00 | 600 | 200 | 200 |
| DP2 | 2.00 | 6.35 | 600 | 200 | 200 |
| DP3 | 2.00 | 5.00 | 800 | 200 | 200 |
| DP4 | 2.00 | 5.00 | 600 | 400 | 200 |
| DP5 | 2.00 | 5.00 | 600 | 200 | 400 |

Figure 12:
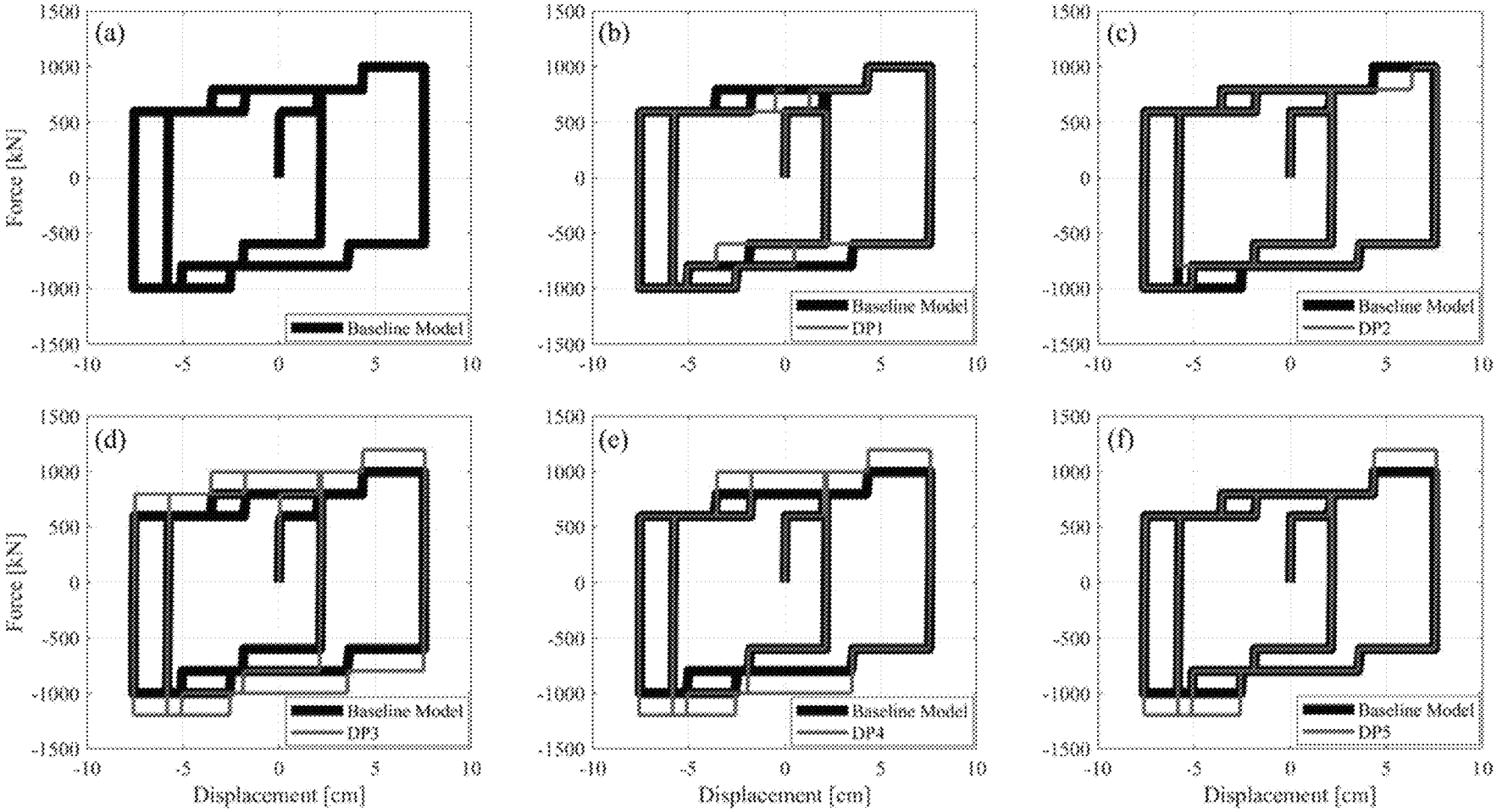
FIG. 12 illustrates the force-displacement responses from six analysis cases of the Truss Model according to some embodiments of the present document.

The Baseline Model assumes the design parameters discussed in the Zero Oversize analysis case. DP1 assumes that the bearing plate in the slot associated with D1 is replaced by a bearing plate that is 3.12 cm shorter compared to the bearing plate assumed in Baseline Model. DP2 assumes that the bearing plate in the slot associated with D2 is replaced by a bearing plate that is 2.70 cm shorter compared to the bearing plate assumed in Baseline Model. DP1 and DP2 can be accomplished by replacing the associated bearing plates without revising the design of the remaining components of the Modified FD. DP3 assumes that F1 is changed from 600 kN to 800 kN, which represents a case when the number of bolts contributing to F1 is increased from six to eight. DP4 assumes that F2 is changed from 200 kN to 400 kN, which represents a case when the number of bolts contributing to F2 is increased from two to four. DP5 assumes that F3 is changed from 200 kN to 400 kN, which represents a case when the number of bolts contributing to F3 is increased from two to four. Static structural analyses are conducted using the displacement history shown in FIG. 8(*a*). FIG. 12(*a*) shows the force-displacement response computed from the analysis of the Baseline Model. FIG. 12(*b*) through (*f*) compare the force-displacement response of the baseline model with the force-displacement responses computed from the analysis of DP1, DP2, DP3, DP4, and DP5. The results demonstrate that the performance of the friction device 500 may be controlled by selecting the design parameters that lead to predefined forces at target displacement levels.

The force and displacement seismic demands in the friction device 500 may be computed using results from a numerical earthquake simulation of a model of a reinforced concrete core wall building with friction devices 500. The computed displacement demands can be used as applied displacement histories in future testing for the experimental characterization of the kinematics and the force-displacement response of the friction device 500. The friction device 500 between each floor and core wall pier is simulated using a Truss Model. The seismic response of the building model with friction devices 500 is compared with the seismic response of the building model with monolithic connections and the seismic response of the building model with friction devices with constant friction forces. It is shown that the friction device 500 may develop discrete variable limiting forces transferred between the floors of the flexible gravity load resisting system and the core wall piers within design target displacement levels. These descriptions are provided for illustration purposes and not intended to be limiting. For example, the seismic response of core wall buildings with friction devices 500 may also be evaluated.

Figure 13:
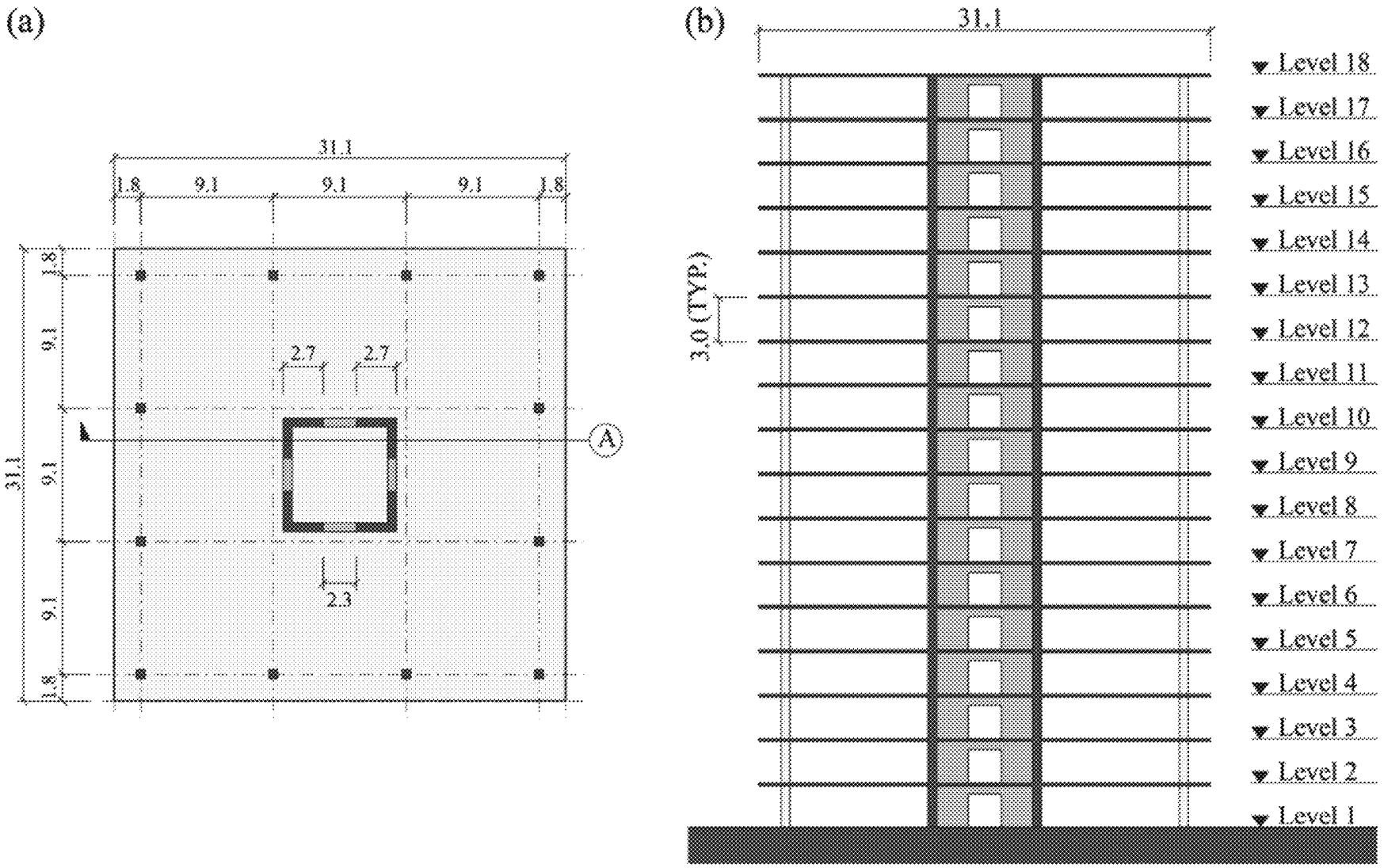
FIG. 13 illustrates (a) an example floor plan and (b) section A the example floor plan in (a) of an eighteen-story building (all dimensions are in meters).

An example eighteen-story reinforced concrete core wall building as illustrated in FIG. 13 is used in the analysis. The seismic force-resisting system of the building is a core wall with four L-shaped wall piers connected by coupling beams along the height of the structure, as shown in FIG. 13. The typical story height is 3.0 m (i.e., 10 ft), the length of the wall is 2.7 m (i.e., 9 ft), and the aspect ratio of the coupling beam is 3.0 with a length of 2.3 m (i.e., 7.5 ft) and a height of 0.8 m (i.e., 30 in). The slab is 0.2 m (i.e., 8 in) thick with a 1.8 m (i.e., 6 ft) cantilever slab overhang. Twelve gravity columns are located along the edge of the slab with a 9.1 m (i.e., 30 ft) distance. The structure was designed for Seismic Design Category (SDC) Dmax as defined in FEMA P695.

Figure 14:
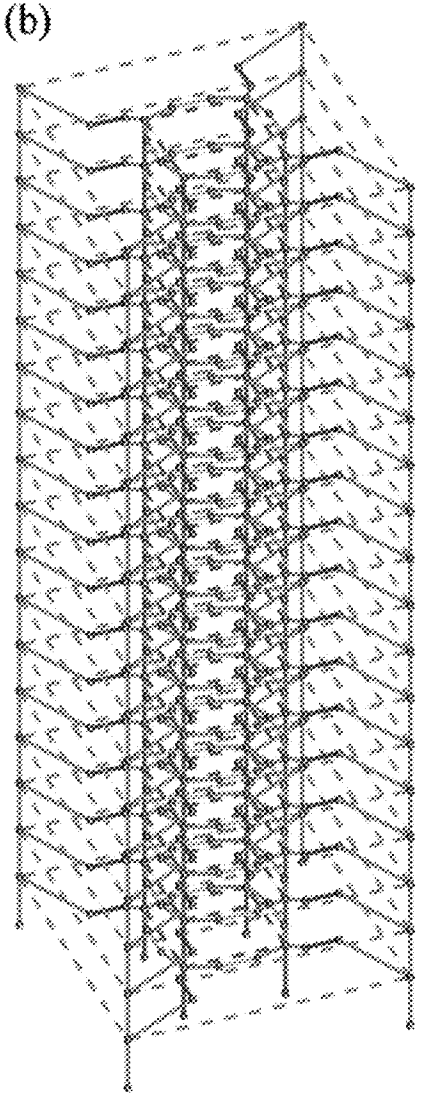
FIG. 14 illustrates a schematic representation of (a) the eighteen-story core wall building as illustrated in FIG. 13 with friction devices according to some embodiments of the present document, (b) a numerical model of the eighteen-story core wall building, and (c) an example floor simulated in the numerical model of the building according to some embodiments of the present document.
Figure 14:
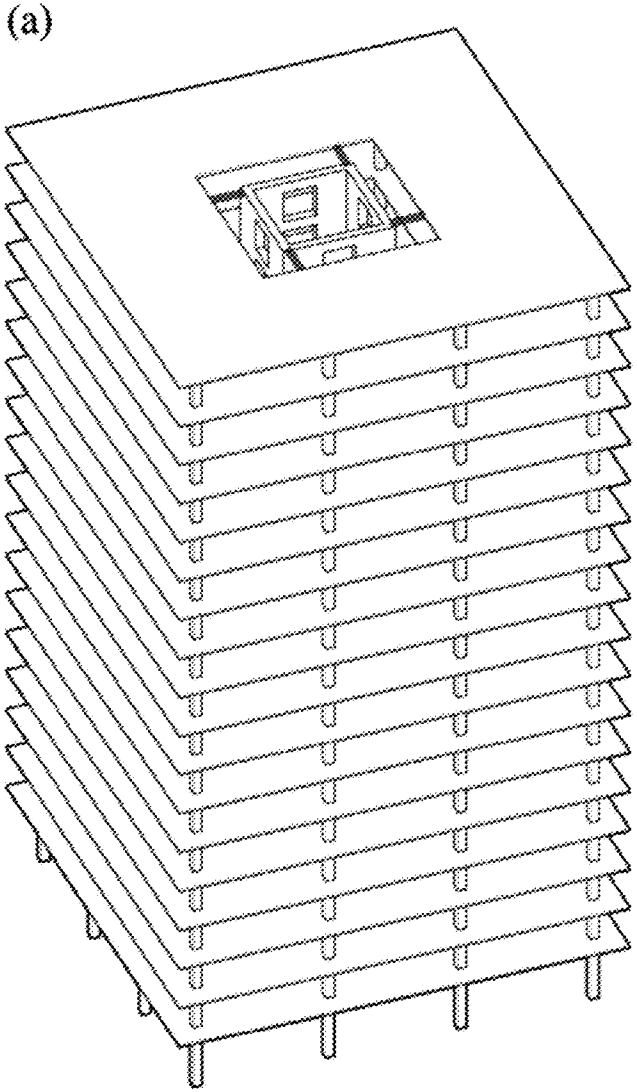
Figure 14:
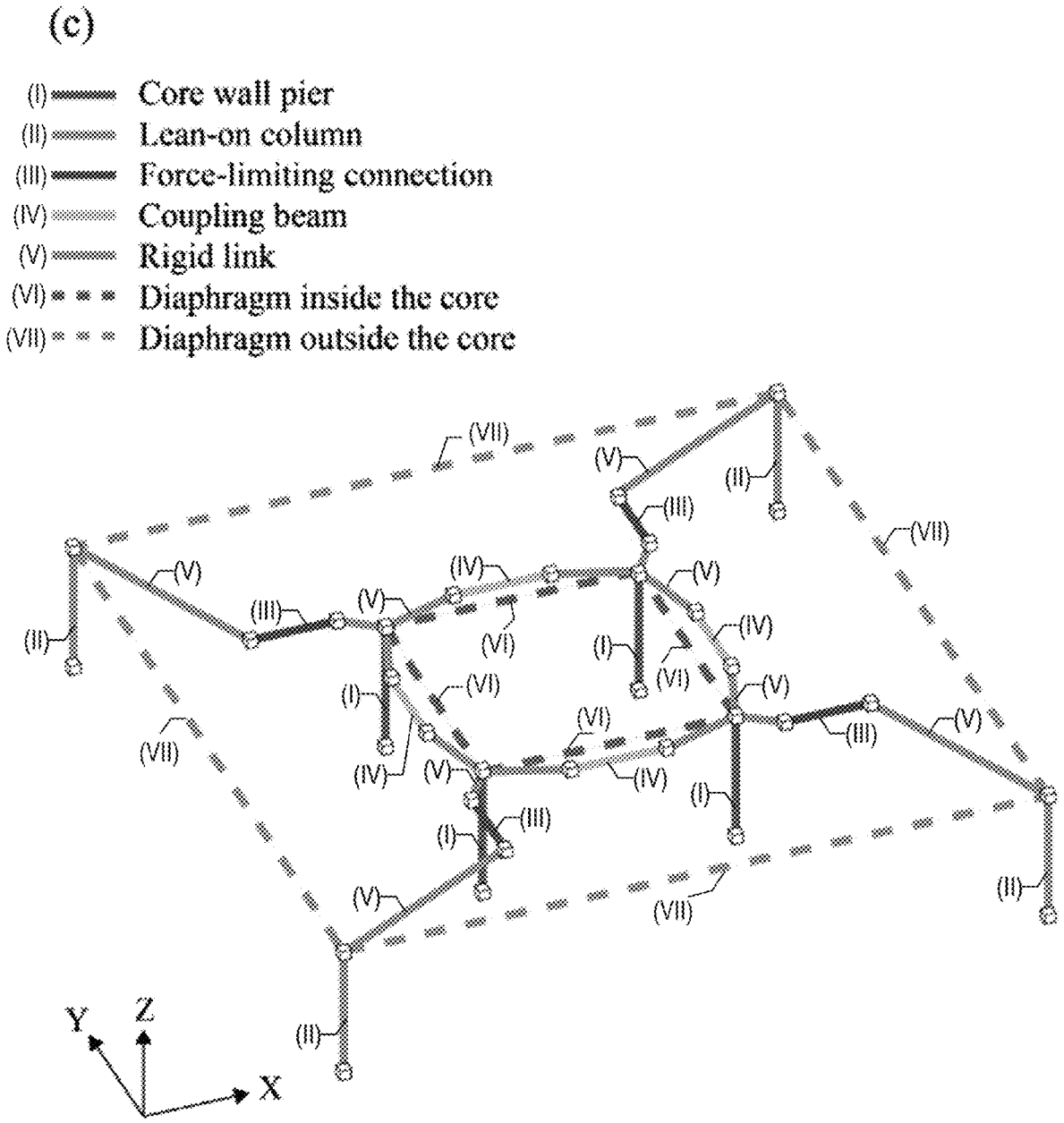

A three-dimensional numerical model of this eighteen-story core wall building with added friction devices 500 between the floors and the core wall piers is developed in OpenSees. FIG. 14 shows the schematic representation of the eighteen-story core wall building with the friction devices 500, the numerical model of the eighteen-story core wall building, and a typical simulated floor in the numerical model of the eighteen-story core wall building. The four piers of the core wall in each story of the building model are simulated using force-based nonlinear elements with fiber sections. The inelastic response of the coupling beams that are connecting the wall piers is simulated using lumped plasticity zero-length elements. The gravity columns are simulated using four linear elastic beam-column elements with section properties that aggregate the cracked section properties of the gravity columns. Rigid in-plane behavior is assumed for the diaphragms. The Truss Model is used to simulate the friction device 500. The design parameters used in the model are D1=2.0 cm, D2=5.0 cm, and F2=F3=200 kN. The values of F1 on the 18th floor, 17th floor, 16th floor, 15th floor, and 1st-14th floor are 1262 kN, 1082 kN, 902 kN, 722 kN, and 614 kN, respectively. The values of F1 at each floor are computed using a force-based method proposed by prior studies. This method is modified from the ASCE/SEI 7-16 alternative seismic design force method for floor diaphragms. Numerical earthquake simulations demonstrate that using this method in designing reinforced concrete planar wall buildings with force-limiting connections may result in reasonable connection deformation demands and relatively uniform distribution connection deformation demands over the height of the building.

Figure 15:
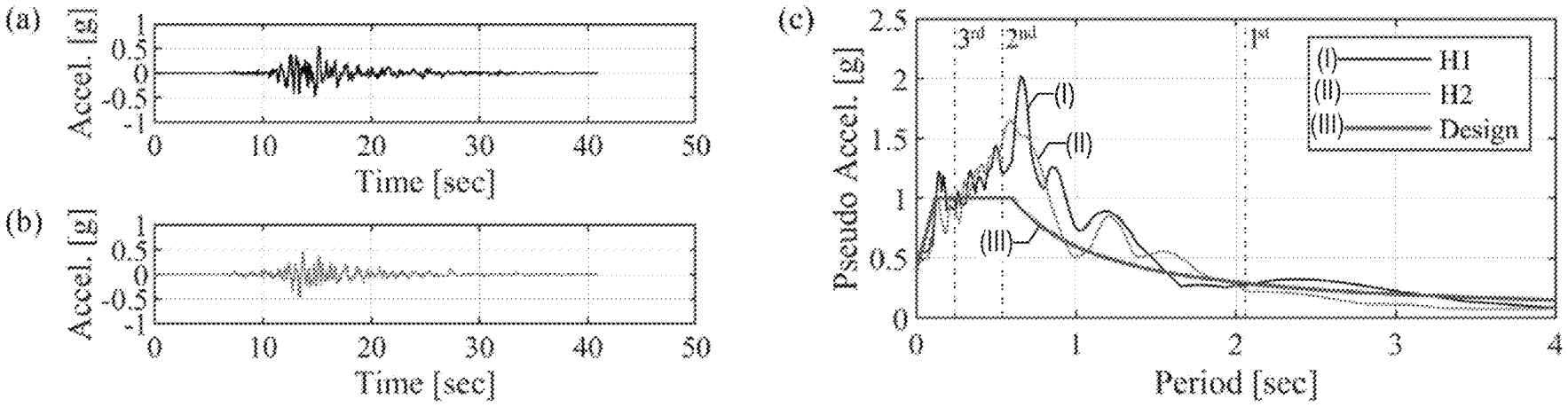
FIG. 15 illustrates scaled ground acceleration of the two horizontal components (a) SHI000 (H1) and (b) SHI090 (H2), and (c) pseudo acceleration response spectra of scaled ground motions and design spectrum with a 5% damping ratio according to some embodiments of the present document.

The building model is subjected to a ground motion recorded at Shin-Osaka station during the 1995 earthquake in Kobe, Japan, scaled to the design level of the expected earthquake ground motion. The two horizontal components of the scaled ground acceleration, SHI000 (H1) and SHI090 (H2), are shown in FIG. 15(*a*) and FIG. 15(*b*), respectively. FIG. 15(*c*) shows the response spectra of the scaled ground motion and the design spectrum with a 5% damping ratio. In FIG. 15(*c*), line I corresponds to results relating to H1, line II corresponds to results relating to H2, and line III corresponds to results relating to the friction device 500. The natural periods of the first, second, and third translational modes (indicated by the vertical dotted lines in FIG. 15(*c*)) of the building model properties are also plotted in FIG. 15(*c*). H1 and H2 are applied at the base of the building model along the global X- and Y-directions (e.g., indicated by the axis x and axis y as illustrated in FIG. 7), respectively.

Figure 16:
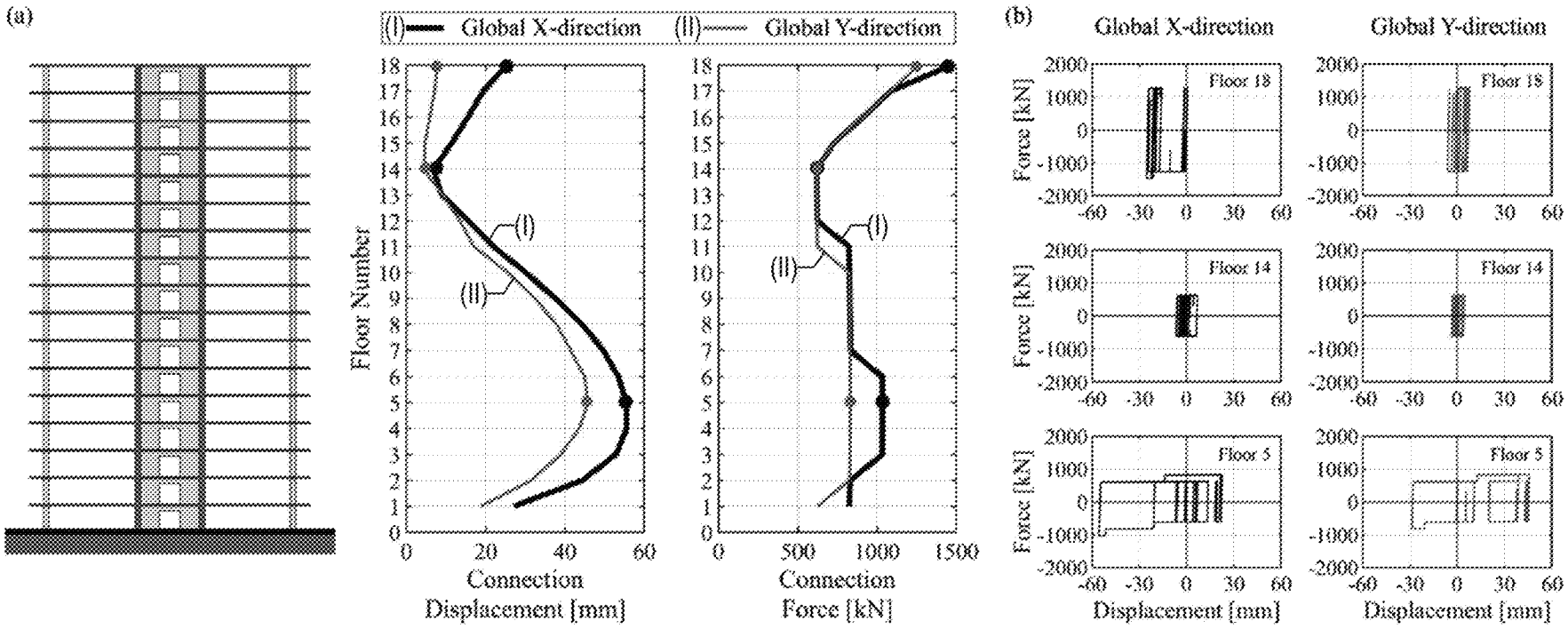
FIG. 16 illustrates peak force and peak displacement responses in a friction device, and (b) force-displacement response of a friction device at floor levels 5, 14, and 18 according to some embodiments of the present document.

FIG. 16 shows the force and displacement seismic responses of the Modified FD computed using analysis results from the numerical earthquake simulation. FIG. 16(*a*) shows the peak (i.e., absolute maximum) response of the friction device connection displacement and connection forces over the height of the building model. The peak responses are computed at each floor level. Lines I are associated with the peak responses in the global X-direction, and lines II are associated with the peak responses in the global Y-direction. The peak connection forces show the activation of different force levels at different floors to limit the displacement demand. For example, due to the contribution of the second and higher translational mode responses in the total dynamic response of the building, the peak connection deformation is the largest near floor levels from 3 to 6, and larger connection forces are activated at the corresponding floor levels to limit the large displacement demand. FIG. 16(*b*) shows the force-displacement responses of the friction devices 500 at floor levels 5, 14, and 18, representing the largest response, the smallest response, and the response at the roof, respectively. On the 5th floor, the connection force reached F1+F2+F3 and F1+F2 in the global X- and Y-directions, respectively. On the 14th floor, where the deformation is the smallest, only the connection force F1 is activated in both the global X- and Y-directions. On the 18th floor, the connection force reached F1+F2 and F1 in the global X- and Y-directions, respectively. The numerical earthquake simulation results show that the friction device 500 may limit the forces transferred from the floors to the core wall piers in a controlled manner through predetermined discrete variable force-displacement response of the friction device 500 simulated using the Truss Model.

The seismic responses of the eighteen-story reinforced concrete core wall building model with three types of connections are compared. The first type of connection assumes conventional monolithic connections between the floors and the core wall system, whose results are shown using lines I in FIG. 17; the second type of connection assumes the use of friction devices with constant friction forces, termed FD, whose results are shown using lines II in FIG. 17; the third type of connection assumes the use of Modified FDs (e.g., the friction device 500), whose results are shown using lines III in FIG. 17. The monolithic connections are simulated using a linear-elastic force-displacement response with high elastic stiffness to approximate a rigid behavior. The FDs are simulated using elastic-perfectly plastic force-displacement response (i.e., zero post-elastic stiffness). The elastic stiffness of the FDs is equal to the elastic stiffness of the Modified FDs. The post-elastic force of the FDs is equal to F1 discussed in connection with FIGS. 13-15.

Figure 17:
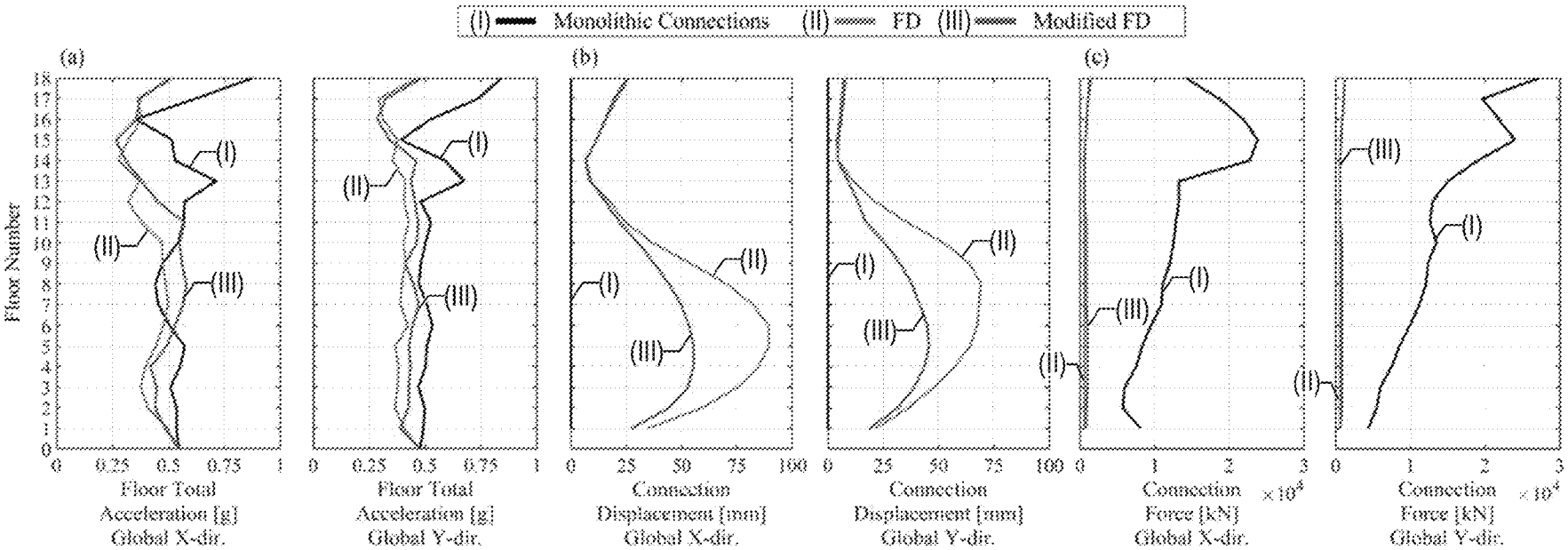
FIG. 17 illustrates peak floor total acceleration, peak connection displacement, and peak connection force according to some embodiments of the present document.

FIG. 17 shows the peak floor total acceleration, the peak connection displacement, and the peak connection force in global X- and Y-directions over the height of the building model. The use of FDs or Modified FDs reduces the peak floor total acceleration and the peak connection force compared to the use of monolithic connections. In addition to the reduction of acceleration and force responses, the use of Modified FDs effectively reduces the peak connection displacement compared to the use of FDs. The peak connection displacement of the monolithic connections is close to zero due to the high connection stiffness.

The numerical earthquake simulation results show that the use of the Modified FDs (e.g., the friction device 500) can limit the seismic induced horizontal forces transferred from the floors to the core wall of the example building model without inducing excessive connection displacement demand. The models described herein may be used to determine the effect of the characteristics of earthquake strong ground motions in the seismic response of multistory reinforced concrete core wall buildings with Modified FDs and to determine the values of the design parameters of the Modified FD that result in target seismic performance of core wall buildings.

Figure 18:
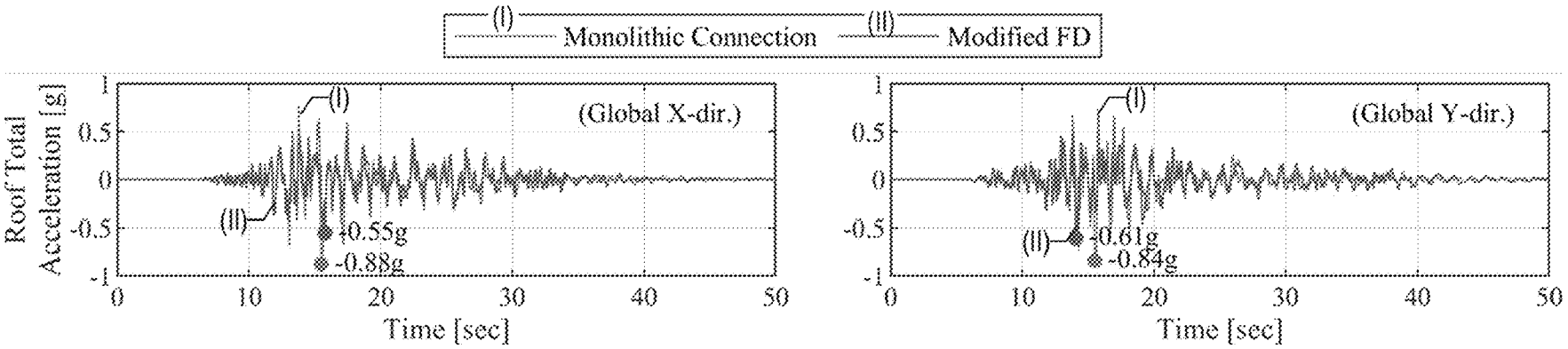
FIG. 18 illustrates a time history response of a roof total acceleration of a building model with the monolithic connections and with the Modified FD according to some embodiments of the present document.

FIG. 18 illustrates a time history response of a roof total acceleration of a building model with the monolithic connections (lines I) and with the Modified FD (lines II) according to some embodiments of the present document. The use of the Modified FD (e.g., the friction device 500) reduces the roof total acceleration. There is a 38% and 27% reduction in the peak total acceleration in global X-direction and in global Y-direction, respectively.

Figure 19:
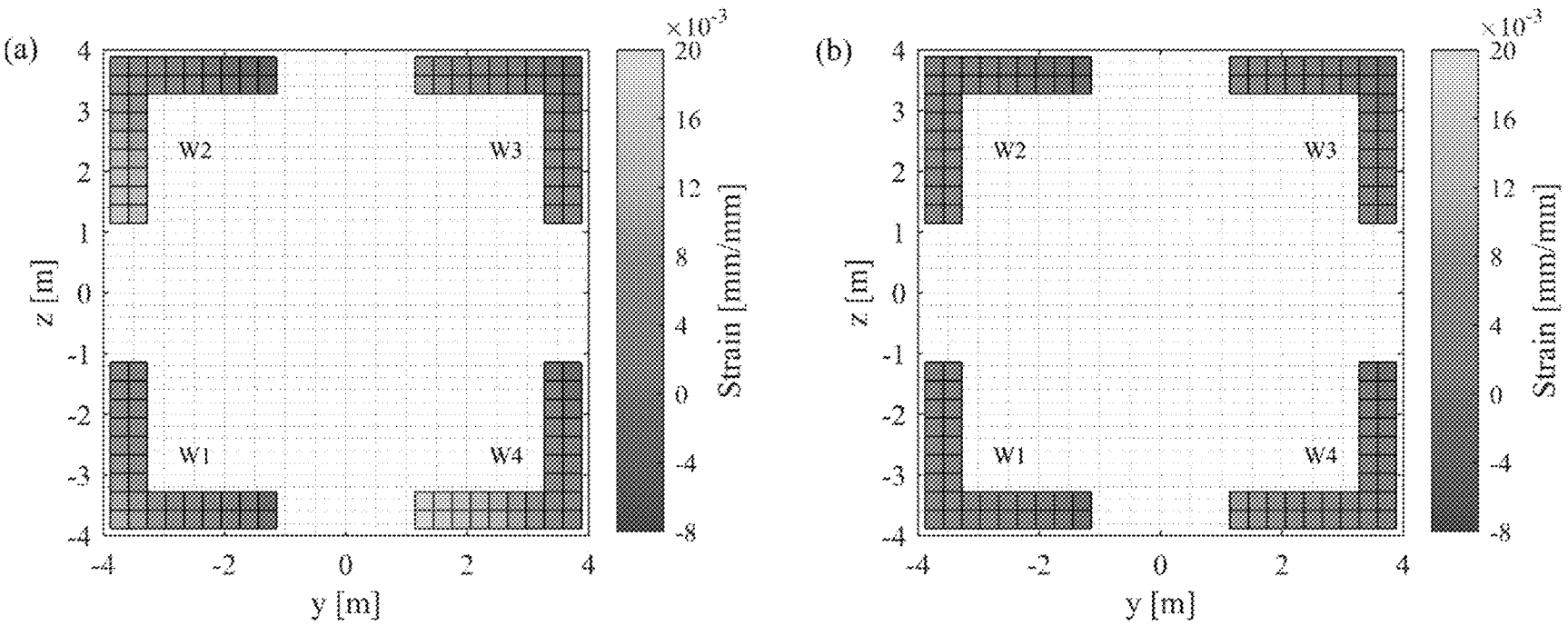
FIG. 19 illustrates a strain distribution at the base of core wall piers for the case in FIG. 18 with (a) monolithic connections and (b) Modified FDs determined according to some embodiments of the present document.

FIG. 19 illustrates a strain distribution at the base of core wall piers for the case in FIG. 18 with (a) monolithic connections and (b) Modified FDs determined according to some embodiments of the present document. FIG. 19 shows the distribution of the strain demand at the base section of the core wall piers at the time when the moment reaction is equal to the absolute maximum value of the moment reactions from the four core wall piers. The use of the Modified FD reduced the absolute values of the maximum and minimum strain in the core wall base section by approximately 49% and 54%, respectively, compared to the use of monolithic connections. The reduction in the magnitude of the strain demands indicates a potential reduction in the expected structural damage in the core wall piers.

EXAMPLES

The following examples are illustrative of several embodiments in accordance with the present technology. Other exemplary embodiments of the present technology may be presented prior to the following listed examples, or after the following listed examples.

1. A friction device for dissipating seismic energy in a structure, including: two external plates and an internal plate arranged substantially parallel to each other, wherein the internal plate is positioned between the two external plates and wherein a first friction force is generated by a movement of the two external plates relative to the internal plate; a set of auxiliary pads in contact with the internal plate, wherein a second friction force is generated by a movement of the auxiliary pads relative to the internal plate in response to a movement of the one or both of the two external plates that exceeds a predetermined value; and a set of fasteners configured to attach the two external plates to each other and to exert a normal force thereupon, wherein the at least one of the first friction force or the second friction force depend on the normal force, and wherein the friction device is configured to dissipate at least a portion of the seismic energy due to at least one of the first friction force or the second friction force.

2. The friction device of any one or more of the solutions provided herein, in which the set of fasteners include a plurality of bolts configured to permit modulation of the normal force.

3. The friction device of any one or more of the solutions provided herein, in which the internal plate has a slot configured to guide a movement of at least one of the two external plates relative to the internal plate or the movement of the set of auxiliary pads moving relative to the internal plate.

4. The friction device of any one or more of the solutions provided herein, in which: the set of fasteners includes a plurality of bolts, the internal plate has a plurality of slots configured to guide the two external plates moving relative to the internal plate, and each of the plurality of bolts is coupled to at least one of the plurality of slots to attach the two external plates such that movements of the two external plates are substantially synchronous.

5. The friction device of any one or more of the solutions provided herein, including a second set of fasteners configured to exert a second normal force on the set of auxiliary pads, wherein the second friction force depends on the second normal force.

6. The friction device of any one or more of the solutions provided herein, in which: the set of auxiliary pads includes two auxiliary pads positioned on opposite sides of the internal plate, and the second set of fasteners are configured to attach the two auxiliary pads such that movements of the two auxiliary pads are substantially synchronous.

7. The friction device of any one or more of the solutions provided herein, in which the second set of fasteners include a plurality of bolts configured to permit modulation of the second normal force.

8. The friction device of any one or more of the solutions provided herein, in which: at least one of the two external plates has an opening configured to couple the set of auxiliary pads such that the movement of the set of auxiliary pads is substantially synchronous with the movement of at least one of the two external plates in response to a movement of the one or both of the two external plates that exceeds the predetermined value.

9. The friction device of any one or more of the solutions provided herein, in which: the set of auxiliary pads includes two auxiliary pads, and each of the two external plates has an opening configured to couple one of the two auxiliar pads such that a movement of the coupled auxiliary pad is substantially synchronous with a movement of the external plate.

10. The friction device of any one or more of the solutions provided herein, further including a second set of fasteners, in which: the two auxiliary pads are positioned on opposite sides of the internal plate, the internal plate has a slot configured to guide a movement of two auxiliary pads relative to the internal plate, and the second set of fasteners are configured to attach the two auxiliary pads such that the movement of two auxiliary pads is substantially synchronous.

11. The friction device of any one or more of the solutions provided herein, in which: the set of auxiliary pads includes a first auxiliary pad and a second auxiliary pad, and at least one of the two external plates has a first opening and a second opening, the first opening being configured to couple the first auxiliary pad in response to a movement of the external plate that exceeds a first predetermined value such that a movement of the first auxiliary pad is substantially synchronous with the at least one external plate, and the second opening being configured to couple the second auxiliary pad in response to a movement of the external plate that exceeds a second predetermined value such that a movement of the second auxiliary pad is substantially synchronous with the at least one external plate.

12. The friction device of any one or more of the solutions provided herein, in which the first opening and the second opening have a same opening size.

13. The friction device of any one or more of the solutions provided herein, in which: the first opening has a first opening size, and the second opening have a second opening size that is different from the first opening size.

14. The friction device of any one or more of the solutions provided herein, in which: each of the two external plates has one or more openings, each of the openings being configured to couple one of the set of auxiliary pads in response to a movement of the external plate that exceeds the predetermined value such that a movement of the coupled auxiliary pad is substantially synchronous with the external plate where the opening is located.

15. The friction device of any one or more of the solutions provided herein, in which each of the set of auxiliary pads includes a friction shim and a bearing plate, the friction shim being configured to form a sliding interface with the internal plate, and the bearing plate being configured to be coupled to one of the two external plates to cause the friction shim to move.

16. The friction device of any one or more of the solutions provided herein, in which each of the two external plates is spaced from the internal plate by a friction shim configured to form a sliding interface with the internal plate.

17. The friction device of any one or more of the solutions provided herein, in which the internal plate has a first end attached to a first portion of the structure and a second end located between the two external plates.

18. The friction device of any one or more of the solutions provided herein, in which the first end of the internal plate is attached to the first portion of the structure via a clevis connection.

19. The friction device of any one or more of the solutions provided herein, in which each of the two external plates has a first end attached to a second portion of the structure, in which each of the two external plates has a first end attached to a second portion of the structure, wherein the seismic energy causes a relative movement between the first portion and the second portion of the structure.

20. The friction device of any one or more of the solutions provided herein, in which the first portion or the second portion of the structure includes a floor, a foundation, a wall, a beam, or a brace.

21. The friction device of any one or more of the solutions provided herein, in which each of the two external plates is coupled to a seismic force-resisting system that is attached to the second portion of the structure.

22. The friction device of any one or more of the solutions provided herein, in which at least one of the two external plates or the internal plate includes a metal or an alloy.

23. The friction device of any one or more of the solutions provided herein, in which at least one of the two external plates or the internal plate includes a corrosion-resistant coating.

24. The friction device of any one or more of the solutions provided herein, in which at least one of the two external plates or the internal plate includes a pattern of grooves designed to enhance a dissipation of heat generated by at least one of the two external plates moving relative to the internal plate.

25. The friction device of any one or more of the solutions provided herein, in which the friction device is configured to be retrofit within existing structural connections without substantial modification to the structure.

26. The friction device of any one or more of the solutions provided herein, in which the structure is a building, a bridge, or a wind turbine.

27. A friction device for dissipating energy, including: a first friction assembly including a first plate and a second plate, in which a first friction assembly comprising a first plate and a second plate, wherein the first friction assembly is configured to generate a first friction force by a movement and the first plate relative to the second plate, a first fastener assembly configured to exert a first normal force onto the first friction assembly, a second friction assembly comprising a plurality of auxiliary pads, wherein the second auxiliary pads is configured to generate a second friction force by a movement of one or more of the plurality of auxiliary pads relative to the second plate in response to a movement of the first plate that exceeds a predetermined value, a second fastener assembly configured to exert a second normal force onto the second friction assembly, in which: the first friction force relates to the first normal force; the second friction force relates to the second normal force; and the friction device is configured to dissipate the energy by a total friction force that is a sum of the first friction force and the second friction force.

28. The friction device of any one or more of the solutions provided herein, in which the second friction force further relates to a count of auxiliary pads of the second friction assembly that are moving relative to the second plate.

29. The friction device of any one or more of the solutions provided herein, in which the friction device is configured to produce the total friction force whose value is adjustable between one of a plurality of discrete values.

30. The friction device of any one or more of the solutions provided herein, in which the first friction assembly includes a friction shim positioned between the first plate and the second plate and configured to provide a sliding interface with the second plate.

31. The friction device of any one or more of the solutions provided herein, in which each of the plurality of auxiliary pads include a friction shim and a bearing plate, the friction shim being configured to form a sliding interface with the second plate, and the bearing plate being configured to be coupled to the first plate to cause the friction shim to move.

32. An energy dissipation system for a structure, including: a plurality of friction devices, in which each of the plurality of friction devices includes: a first friction assembly comprising a first plate and a second plate, in which the first friction assembly is configured to generate a first friction force by a movement of the first plate relative to the second plate, a first fastener assembly configured to exert a first normal force onto the first friction assembly, a second friction assembly comprising a plurality of auxiliary pads, wherein the second friction assembly is configured to generate a second friction force by a movement of one or more of the plurality of auxiliary pads relative to the second plate when the one or more of the plurality of auxiliary pads are coupled to the first plate in response to a movement of the first plate that exceeds a predetermined value, and a second fastener assembly configured to exert a second normal force onto the second friction assembly, in which: the first friction force depends on the first normal force; the second friction force depends on the second normal force; and the friction device is configured to dissipate energy by a total friction force that is a sum of the first friction force and the second friction force, in which the plurality of friction devices are operatively connected to a structural framework of the structure.

33. The energy dissipation system of any one or more of the solutions provided herein, in which the structural framework includes at least one of a beam, a foundation, a column, a floor, or a brace of the structure.

34. The energy dissipation system of any one or more of the solutions provided herein, further including a sensor configured to monitor at least one of the plurality of friction devices or the structural framework.

35. The energy dissipation system of any one or more of the solutions provided herein, in which the plurality of friction devices include a first friction device and a second friction device that are arranged in a substantially same orientation such that a relative movement between the first plate and the second plate of the first friction device is substantially in a same direction as a relative movement between the first plate and the second plate of the second friction device.

36. The energy dissipation system of any one or more of the solutions provided herein, in which the plurality of friction devices include a first friction device and a second friction device that are arranged in different orientations such that a relative movement between the first plate and the second plate of the first friction device is in a different direction than a relative movement between the first plate and the second plate of the second friction device.

37. The energy dissipation system of any one or more of the solutions provided herein, in which the first friction device and the second friction device are arranged substantially perpendicular to each other such that the relative movement between the first plate and the second plate of the first friction device is substantially perpendicular to the relative movement between the first plate and the second plate of the second friction device.

CONCLUSION

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present technology have been shown and described, it will be obvious to those skilled in the art that, based upon the teachings herein, changes and modifications may be made without departing from this technology and its broader aspects and, therefore, the appended claims are to encompass within their scope all such changes and modifications as are within the true spirit and scope of this technology. Furthermore, it is to be understood that the technology is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to technologies containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Conjunctive language, such as phrases of the form "at least one of A, B, and C," or "at least one of A, B and C," (i.e., the same phrase with or without the Oxford comma) unless specifically stated otherwise or otherwise clearly contradicted by context, is otherwise understood with the context as used in general to present that an item, term, etc., may be either A or B or C, any nonempty subset of the set of A and B and C, or any set not contradicted by context or otherwise excluded that contains at least one A, at least one B, or at least one C. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}, and, if not contradicted explicitly or by context, any set having {A}, {B}, and/or {C} as a subset (e.g., sets with multiple "A"). Thus, such conjunctive language is not generally intended to imply that certain embodiments require at least one of A, at least one of B, and at least one of C each to be present. Similarly, phrases such as "at least one of A, B, or C" and "at least one of A, B or C" refer to the same as "at least one of A, B, and C" and "at least one of A, B and C" refer to any of the following sets: {A}, {B}, {C}, {A, B}, {A, C}, {B, C}, {A, B, C}, unless differing meaning is explicitly stated or clear from context.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described in this patent document should not be understood as requiring such separation in all embodiments.

Only a few implementations and examples are described and other implementations, enhancements and variations can be made based on what is described and illustrated in this patent document.

What is claimed is:

1. A friction device for dissipating seismic energy in a structure, comprising:

a first friction assembly including two external plates and an internal plate arranged substantially parallel to each other, wherein the internal plate is positioned between the two external plates and wherein the two external plates and the internal plate are configured such that a first friction force is generated when the two external plates move relative to the internal plate;

a second friction assembly including a set of auxiliary pads in contact with the internal plate, wherein the auxiliary pads and the internal plate are configured such that a second friction force is generated by a movement of the auxiliary pads relative to the internal plate in response to a movement of one or both of the two external plates that exceeds a predetermined value; and a fastener system including a set of fasteners configured to attach the two external plates to each other, the fastener system configured to exert a normal force on one or both of the first friction assembly or the second friction assembly, wherein at least one of the first friction force or the second friction force depend on the normal force, and wherein the friction device is configured to dissipate at least a portion of the seismic energy due to at least one of the first friction force or the second friction force, wherein the internal plate has a first end attached to a first portion of the structure and a second end located between the two external plates, each of the two external plates has a first end attached to a second portion of the structure, and the seismic energy causes a relative movement between the first portion and the second portion of the structure.

2. The friction device of claim 1, wherein fastener system includes a plurality of bolts configured to permit modulation of the normal force.

3. The friction device of claim 1, wherein the internal plate has a slot configured to guide a movement of at least one of the two external plates relative to the internal plate or the movement of the set of auxiliary pads moving relative to the internal plate.

4. The friction device of claim 1, wherein:

the fastener system includes a plurality of bolts, the internal plate has a plurality of slots configured to guide the two external plates moving relative to the internal plate, and each of the plurality of bolts is coupled to at least one of the plurality of slots to attach the two external plates such that movements of the two external plates are substantially synchronous.

5. The friction device of claim 1, comprising a second set of fasteners configured to exert a second normal force on the set of auxiliary pads, wherein the second friction force depends on the second normal force.

6. The friction device of claim 5, wherein the second set of fasteners includes a plurality of bolts configured to permit modulation of the second normal force.

7. The friction device of claim 1, wherein:

at least one of the two external plates has an opening configured to couple the set of auxiliary pads such that the movement of the set of auxiliary pads is substantially synchronous with the movement of at least one of the two external plates in response to a movement of the one or both of the two external plates that exceeds the predetermined value.

8. The friction device of claim 1, wherein:

the set of auxiliary pads includes a first auxiliary pad and a second auxiliary pad, and at least one of the two external plates has a first opening and a second opening, the first opening being configured to couple the first auxiliary pad in response to a movement of the external plate that exceeds a first predetermined value such that a movement of the first auxiliary pad is substantially synchronous with the at least one external plate, and the second opening being configured to couple the second auxiliary pad in response to a movement of the external plate that exceeds a second predetermined value such that a movement of the second auxiliary pad is substantially synchronous with the at least one external plate, wherein:

the first opening has a first opening size, and the second opening has a second opening size that is different from the first opening size.

9. The friction device of claim 1, wherein each of the set of auxiliary pads includes a friction shim and a bearing plate, the friction shim being configured to form a sliding interface with the internal plate, and the bearing plate being configured to be coupled to one of the two external plates to cause the friction shim to move.

10. The friction device of claim 1, wherein each of the two external plates is spaced from the internal plate by a friction shim configured to form a sliding interface with the internal plate.

11. The friction device of claim 1, wherein at least one of the two external plates or the internal plate comprises a metal or an alloy.

12. The friction device of claim 1, wherein at least one of the two external plates or the internal plate comprises a corrosion-resistant coating.

13. The friction device of claim 1, wherein the friction device is configured to be retrofit within existing structural connections without substantial modification to the structure.

14. The friction device of claim 1, wherein the structure is a building, a wind turbine, or a bridge.

15. A friction device for dissipating energy, comprising:

a first friction assembly comprising a first plate and a second plate, wherein the first friction assembly is configured to generate a first friction force by a movement of the first plate relative to the second plate, a first fastener assembly configured to exert a first normal force onto the first friction assembly, a second friction assembly comprising a plurality of auxiliary pads, wherein the second auxiliary pads is configured to generate a second friction force by a movement of one or more of the plurality of auxiliary pads relative to the second plate in response to a movement of the first plate that exceeds a predetermined value, and a second fastener assembly configured to exert a second normal force onto the second friction assembly, wherein:

the first friction force relates to the first normal force;

the second friction force relates to the second normal force; and the friction device is configured to dissipate the energy by a total friction force that is a sum of the first friction force and the second friction force;

wherein each of the plurality of auxiliary pads includes a friction shim and a bearing plate, the friction shim being configured to form a sliding interface with the second plate, and the bearing plate being configured to be coupled to the first plate to cause the friction shim to move.

16. The friction device of claim 15, wherein the second friction force further relates to a number of auxiliary pads of the second friction assembly that are moving relative to the second plate.

17. The friction device of claim 15, wherein the friction device is configured to produce the total friction force whose value is adjustable between one of a plurality of discrete values.

18. An energy dissipation system for a structure, comprising:

a plurality of friction devices, wherein each of the plurality of friction devices comprises:

a first friction assembly comprising a first plate and a second plate, wherein the first friction assembly is configured to generate a first friction force by a movement of the first plate relative to the second plate, a first fastener assembly configured to exert a first normal force onto the first friction assembly, a second friction assembly comprising a plurality of auxiliary pads, wherein the second friction assembly is configured to generate a second friction force by a movement of one or more of the plurality of auxiliary pads relative to the second plate when the one or more of the plurality of auxiliary pads are coupled to the first plate in response to a movement of the first plate that exceeds a predetermined value, and a second fastener assembly configured to exert a second normal force onto the second friction assembly, wherein:

the first friction force depends on the first normal force;

the second friction force depends on the second normal force;

the friction device is configured to dissipate energy by a total friction force that is a sum of the first friction force and the second friction force, wherein the plurality of friction devices are configured to be operatively connected to a structural framework of the structure; and each of the plurality of auxiliary pads includes a friction shim and a bearing plate, the friction shim being configured to form a sliding interface with the second plate, and the bearing plate being configured to be coupled to the first plate to cause the friction shim to move.

19. The friction device of claim 18, wherein:

the second plate has a first end attached to a first portion of the structure, the first plate has a first end attached to a second portion of the structure, and a seismic energy causes a relative movement between the first portion and the second portion of the structure.

20. The friction device of claim 19, wherein the first plate is coupled to a seismic force-resisting system that is attached to the second portion of the structure.

* * * * *